US006803164B2

(12) United States Patent
Mizoo et al.

(10) Patent No.: US 6,803,164 B2
(45) Date of Patent: Oct. 12, 2004

(54) MAGNETIC BLACK TONER

(75) Inventors: Yuichi Mizoo, Ibaraki (JP); Tadashi Dojo, Shizuoka (JP); Nene Shibayama, Shizuoka (JP); Yusuke Hasegawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 10/238,782

(22) Filed: Sep. 11, 2002

(65) Prior Publication Data

US 2003/0122911 A1 Jul. 3, 2003

(30) Foreign Application Priority Data

Sep. 12, 2001 (JP) ..... 2001-276502

(51) Int. Cl.[7] ..... G03G 9/083
(52) U.S. Cl. ..... 430/106.2; 430/137.2
(58) Field of Search ..... 347/95; 430/106.2, 430/137.2

(56) References Cited

U.S. PATENT DOCUMENTS

| | | | | |
|---|---|---|---|---|
| 4,292,387 | A | 9/1981 | Kanbe et al. | 430/102 |
| 4,356,245 | A | 10/1982 | Hosono et al. | 430/122 |
| 5,240,803 | A | 8/1993 | Ota | 430/106 |
| 5,449,565 | A | 9/1995 | Aoki et al. | 428/694 BA |
| 5,721,433 | A | 2/1998 | Kosaka | 250/573 |
| 5,800,959 | A | 9/1998 | Ikami | 430/126 |
| 6,383,637 | B1 | 5/2002 | Misawa et al. | 428/403 |
| 6,544,708 | B2 * | 4/2003 | Komoto et al. | 430/110.3 |

FOREIGN PATENT DOCUMENTS

| | | |
|---|---|---|
| EP | 0826625 | 8/1997 |
| JP | 54-42141 | 4/1979 |
| JP | 55-18656 | 2/1980 |
| JP | 3-84558 | 4/1991 |
| JP | 3-101743 | 4/1991 |
| JP | 3-101744 | 4/1991 |
| JP | 3-229268 | 10/1991 |
| JP | 4-1766 | 1/1992 |
| JP | 4-102862 | 4/1992 |
| JP | 4-162050 | 6/1992 |
| JP | 6-100317 | 4/1994 |
| JP | 8-133744 | 5/1996 |
| JP | 8-133745 | 5/1996 |
| JP | 8-136439 | 5/1996 |
| JP | 9-26672 | 1/1997 |
| JP | 2000-319021 | 11/2000 |
| JP | 2001-2426 | 1/2001 |
| JP | 2001-312096 | 11/2001 |

* cited by examiner

*Primary Examiner*—John L Goodrow
(74) *Attorney, Agent, or Firm*—Fitzpatrick, Cella, Harper & Scinto

(57) ABSTRACT

A magnetic black toner comprising magnetic black toner particles containing at least a binder resin and a magnetic material. The toner has a weight-average particle diameter of from 5 μm to 12 μm, and the toner has, in its particles of 3 μm or more in diameter, at least 90% by number of particles with a circularity of 0.900 or more and has an average circularity of from 0.940 to 0.970. The magnetic material comprises iron oxide particles which have an average particle diameter of from 0.10 μm to 0.30 μm, contain titanium or a titanium compound in an amount of from 0.3% by weight to 1.5% by weight in terms of titanium, based on the total weight of the iron oxide particles, and have the ratio of the proportion of FeO to the total Fe content in 10% by weight from the particle surface, A %, to the proportion of FeO to the total Fe content in the remainder 90% by weight, B %, which satisfies the expression: $0.7 \leqq A/B \leqq 1.0$. Also, an inorganic fine powder is externally added to the toner particle surfaces.

10 Claims, No Drawings

MAGNETIC BLACK TONER

BACKGROUND OF THE INVENTION

1. Field of the Invention

This invention relates to a magnetic black toner used in image-forming processes such as electrophotography, electrostatic recording, electrostatic printing and toner jet recording.

2. Related Background Art

As the electrophotography, recorded images are commonly obtained by forming an electrostatic latent image on a photosensitive member by various means utilizing a photoconductive material, subsequently developing the latent image by the use of a toner to form a toner image, and transferring the toner image to a transfer material such as paper as occasion calls, followed using fixing by the action of heat, pressure, heat-and-pressure or solvent vapor.

In recent years, as copying machines and printers have been made to have multiple function, to record images in a higher image quality and to have a higher process speed, toners have also become required to have much severer performances. Accordingly, toners are made smaller in particle diameter (made into fine particles) and are required to have particle size distribution which is sharp enough to contain no coarse particles and less ultrafine powder.

Making toners into fine particles can improve the resolution and sharpness of images, but brings about various problems.

Making a toner have a small particle diameter results in a large specific surface area of the toner to achieve a larger charge quantity itself of the toner, but at the same time results in a broad distribution of its charge quantity to tend to cause fog where the toner is developed in non-image areas. Also, when the toner is transferred from the surface of the photosensitive member to the transfer material and where a toner having been charged in excess is present there, a phenomenon called black spots around line images may occur, in which the toner scatters around characters or line images. Where the toner is not sufficiently charged in order to control such black spots around line images, a toner charged insufficiently is present there to lower developing performance or cause fog.

Moreover, the chargeability of toners more tends to be affected by environment. In order to make this fog less occur, it is also attempted to make toners have a sharp particle size distribution. This, however, may be the cause of a cost increase due to, e.g., a low yield in the production of toners.

Furthermore, as toners are made into fine particles, the dispersibility of internal additives in binder resins more tends to influence the performance of toners. In particular, in the case of a toner having iron oxide particles as a magnetic powder, problems such as a decrease in image density, a lowering of running stability and a lowering of image quality may be caused depending on the state of dispersion of the iron oxide particles.

Where the iron oxide particles stand non-uniform in toner particles, the amount of any iron oxide particles depositing on the surfaces of the toner particles differs between individual particles. Hence, when the toner is triboelectrically charged with a charge-providing member (developing sleeve) and where the iron oxide particles are not present at all on the toner particle surfaces, or present in a very small quantity, the toner particle surfaces are high charged.

Conversely, where the iron oxide particles are present in excess on the toner particle surfaces, the iron oxide particles act as leak sites and the toner particle surfaces are low charged. Thus, the breadth of charge distribution may more increase to cause the above various problems.

Japanese Patent Applications Laid-Open No. 3-101743 and No. 3-101744 disclose that, in order to disperse the magnetic powder uniformly in toner particles, the magnetic powder is made to have a small particle diameter and a narrow particle size distribution. It is true that such measures make it easy for the magnetic powder to be uniformly dispersed in toner particles, but a problem may occur which is due to making the magnetic powder to have a small particle diameter.

Conventionally, the degree of blackness of the iron oxide particles, in particular, iron oxide particles containing FeO (or Fe(II)), such as magnetite is influenced by the content of FeO. However, this FeO content in iron oxide particles decreases with progress of the deterioration with time caused by oxidation after production. As the result, this is accompanied with a phenomenon that the degree of blackness deteriorates. Needless to say, this deterioration with time is greatly influenced by the environment where the iron oxide particles are placed, but the deterioration of the degree of blackness is accelerated as the iron oxide particles are made into fine particles.

In order to obtain iron oxide particles having a high degree of blackness and superior environmental properties, techniques have ever been disclosed in which various elements are added to iron oxide particles. Such iron oxide particles may include, e.g., iron oxide particles having composite iron oxide coatings containing Co as disclosed in Japanese Patent Applications Laid-Open No. 6-100317 and No. 8-133744, iron oxide particles having composite iron oxide coatings containing Zn as disclosed in Japanese Patent Application Laid-Open No. 8-133745, and iron oxide particles containing a composite iron oxide containing Mn, Zn, Cu, Ni, Co or Mg as disclosed in Japanese Patent Application Laid-Open No. 4-162050.

The role of these additive elements is to keep the degree of blackness from deteriorating, by covering particles with an additive-element oxide so that the FeO does not come into direct contact with the outside atmosphere, or by replacing the FeO with an additive-element oxide that may not cause a decrease in the degree of blackness.

The iron oxide particles obtained by such methods can prevent the degree of blackness from decreasing or can keep it from deteriorating with time. However, their uniform dispersion in toner particles is insufficient, and some additive elements may affect magnetic properties of the iron oxide particles themselves to cause defects concerned with development other than a tint.

In the image-forming process described above, transfer residual toner is present on the photosensitive member after the toner image has been transferred from the surface of the photosensitive member to the transfer medium.

In order to perform continuous copying quickly, this residual toner on the photosensitive member must be removed by cleaning. The residual toner thus removed and collected is further put into a container or collection box provided inside the main body, and thereafter discarded or recycled through a suitable step.

To grapple with environmental problems, a construction designed to provide a recycle system inside the main body is required as a waste-tonerless system. However, in order to make copying machines and printers have multiple function, record images in a higher image quality and have a much higher process speed, a fairly large recycle system is required in the main body, resulting in large copying machines and printers in themselves. This is not feasible for making machines small-size from the viewpoint of space saving. Making machines small-size is similarly not feasible also in a system in which the waste toner is held in a container or collection box provided inside the main body and a system in which the photosensitive member and the part where the waste toner is collected are set in one unit.

To deal with these adequately, it is necessary to improve the transfer efficiency required when the toner image is transferred from the surface of the photosensitive member to the transfer medium.

Japanese Patent Application Laid-Open No. 9-26672 discloses a method in which in a toner produced by pulverization a transfer efficiency improver having an average particle diameter of 0.1 to 3 $\mu$m and a hydrophobic fine silica powder having a BET specific surface area of 50 to 300 $m^2/g$ are incorporated so that the toner can have a low volume resistance and the transfer efficiency improver can form a thin-film layer on the photosensitive member so as to improve the transfer efficiency. However, since the toner produced by pulverization has particle size distribution, it is difficult to afford a uniform effect on all particles. Accordingly, it is necessary to make further improvement.

As a means for improving the transfer efficiency, Japanese Patent Applications Laid-Open No. 3-84558, No. 3-229268, No. 4-1766 and No. 4-102862 disclose toners produced by processes such as spray granulation, solution dissolution and polymerization so that toner particles can have a shape close to spheres. Production of such toners, however, not only requires large-scale equipment, but also tends to cause a problem concerned with cleaning just because of the toner particles made close to true spheres. Hence, these can not be said to be preferable methods when it is intended only to improve transfer efficiency.

In the image-forming process, for the purpose of improving transfer efficiency, a method is also available in which charging-before-transfer (post-charging) is carried out so as to relax any excess electric charges to improve the transfer efficiency. However, in the case of magnetic black toners, the black spots around line images may seriously occur as a result that the shape of toner particles is made close to spherical shape for the purpose of improving transfer efficiency and the charging-before-transfer (post-charging) is carried out. This is especially remarkable when the proportion of the iron oxide particles present on the toner particle surfaces is non-uniform for each particle.

As common processes for producing toners, a binder resin for making toner fix to transfer mediums, a colorant of various types for giving color to toner and a charge control agent for imparting electric charges to toner particles are used as materials. In addition to such materials, in what is called one-component development as disclosed in Japanese Patent Applications Laid-Open No. 54-42141 and No. 55-18656, a magnetic material of various types for imparting transport performance to the toner itself is added. If necessary, other additives such as a release agent and a fluidity-providing agent are further added, and these are dry-process mixed. Thereafter, the mixture obtained is melt-kneaded by means of a general-purpose kneading machine such as a roll mill or an extruder, followed by cooling to solidify, and then the kneaded product is pulverized by means of a grinding machine of various types such as a jet-stream grinding machine and a mechanical-impact grinding machine. Then the pulverized product obtained is introduced into an air classifier of various types to carry out classification to obtain toner particles put to have particle diameters necessary as toners, optionally followed by further addition of a fluidizing agent or a lubricant and dry-process blending to obtain toners used for image formation.

As methods of making the magnetic black toner spherical for the purpose of improving transfer efficiency, available are a method in which production conditions are designed or a method in which particles are made spherical using a surface-modifying apparatus after the pulverization or classification, when the kneaded product is pulverized by means of the grinding machine of various types such as a jet-stream grinding machine and a mechanical-impact grinding machine.

However, in the case when the jet-stream grinding machine is used, the pulverization must be performed under conditions of soft pulverization to lower its throughput. Also, in the method making use of a surface-modifying apparatus, a lowering of productivity, an increase in equipment and so forth which result from addition of one step on account of toner production must be taken into consideration. From these points of view, it is more preferable to produce the toner by means of the mechanical-impact grinding machine.

Moreover, in the magnetic black toner made spherical, what is relatively important is the compatibility of individual materials contained in toners, so that, in particular, except for binder resins, the characteristics of the iron oxide particles, a magnetic material contained in a large quantity, are hampered by severer restrictions than ever in respect of developing performance, too.

Namely, under the existing conditions, any magnetic black toner having a high developing performance has not been materialized, which has been improved in transfer efficiency for the purpose of lessening the transfer residual toner (waste toner) on the photosensitive member.

SUMMARY OF THE INVENTION

An object of the present invention is to provide a magnetic black toner having a transfer efficiency high enough to leave less waste toner.

Another object of the present invention is to provide a magnetic black toner which has a sufficient degree of blackness even with its particles made finer.

Still another object of the present invention is to provide a magnetic black toner which can maintain a good developing performance even with its particles made finer.

A further object of the present invention is to provide a magnetic black toner which is not affected by any environment of image reproduction, i.e., can maintain a good developing performance even in a high-temperature and high-humidity environment and in a normal-temperature and low-humidity environment.

A still further object of the present invention is to provide a magnetic black toner having a high developing performance, which can well be kept from causing fog and black spots around line images even in the image-forming process having the step of charging-before-transfer (post-charging).

A still further object of the present invention is to provide a magnetic black toner which can be produced in a high productivity with ease by pulverization.

The present invention provides a magnetic black toner having at least a binder resin and a magnetic material, wherein;

the toner has a weight-average particle diameter X ($\mu$m) of from 5 $\mu$m to 12 $\mu$m;

the toner has, in its particles of 3 $\mu$m or more in diameter, at least 90% by number of particles with a circularity (a) of 0.900 or more in number-based circularity distribution of circularity (a) as determined from the following equation (1), and has an average circularity of from 0.940 to 0.970;

$$\text{Circularity } (a)=L_0/L \quad (1)$$

where $L_0$ represents the circumferential length of a circle having the same projected area as a particle image, and L represents the circumferential length of the particle image;

the magnetic material comprises iron oxide particles which:

1) have an average particle diameter of from 0.10 $\mu$m to 0.30 $\mu$m;

2) contain titanium or a titanium compound in an amount of from 0.3% by weight to 1.5% by weight in terms of titanium, based on the total weight of the iron oxide particles; and 3) have the ratio of the proportion of FeO to the total Fe content in 10% by weight from the particle surface, A %, to the proportion of FeO to the total Fe content in the remainder 90% by weight, B %, which satisfies the following expression (2):

$$0.7 \leqq A/B \leqq 1.0 \quad (2);$$

and an inorganic fine powder is externally added to toner particle surfaces.

DETAILED DESCRIPTION OF THE INVENTION

It is conventionally known that the shape of toner particles has influence on various properties of toner. The present inventors have carried on studying the particle diameter and particle shape of magnetic black toners produced by pulverization, and have discovered that the circularity in particles of 3 $\mu$m or more in diameter correlates closely with the transfer performance and developing performance (image quality) and fixing performance.

They have also discovered that, in the case of magnetic black toners containing iron oxide particles in a large quantity, the characteristics of the iron oxide particles are greatly concerned in developing performance and a black tint of images.

Making a toner have a small particle diameter results in a large specific surface area of the toner. This makes the toner more agglomerative and adherent. Hence, when the toner image is transferred to the transfer material from the photosensitive member surface, the adherent force acting between the photosensitive member and the toner is so strong as to lower the transfer efficiency. In particular, magnetic black toners produced by conventional pulverization, which have non-uniform and square particle shape, have this tendency remarkably.

They have further discovered that, in the case of fine-particle magnetic black toners containing iron oxide particles in a large quantity, the state of dispersion of the iron oxide particles is greatly concerned especially in developing performance pertaining to fog and black spots around line images. Namely, in order to improve transfer efficiency, even though the toners have a small particle diameter, it is important for them to be endowed with a low adherence which is equal to or beyond that of toners with ordinary particle diameter.

In addition, in order to control the dispersion of iron oxide particles in toner, it is important to make the iron oxide particles themselves have a small particle diameter (fine particles). Making the iron oxide particles themselves into fine particles enables achievement of their uniform state of dispersion in toner. However, making the iron oxide particles into fine particles accelerates the deterioration of FeO (or Fe(II)) in the iron oxide particles as stated previously, and makes it difficult to maintain the black tint as the magnetic black toners.

Namely, in the case when the iron oxide particles themselves are made into fine particles for the purpose of controlling the state of dispersion of the iron oxide particles in the magnetic black toner, it has been necessary to make further studies in order to achieve both the image quality and the black tint as an image grade.

More specifically, as a range within which the iron oxide particles can uniformly be dispersed in the toner, it is important for the iron oxide particles to have an average particle diameter of from 0.10 $\mu$m to 0.30 $\mu$m, and preferably from 0.10 $\mu$m to 0.20 $\mu$m. A case in which the iron oxide particles have an average particle diameter of more than 0.30 $\mu$m is undesirable because, though there is no problem in the case of toners with a large particle diameter, any uniform dispersion can not be achieved in the case of fine-particle toners and any serious fog, black spots around line images and so forth may be accelerated. A case in which they have an average particle diameter of less than 0.10 $\mu$m is also undesirable because the iron oxide particles may deposit on the toner particle surfaces in large a quantity to cause a lowering of developing performance, a serious occurrence of fog and so forth because of faulty charging due to an increase in the leak sites.

It must further be taken into consideration that making the iron oxide particles into fine particles for the purpose of uniform dispersion brings about the problem on the color tint of the iron oxide particles themselves as stated previously. Where the iron oxide particles themselves have turned reddish as a result of any acceleration of deterioration due to their oxidation, the color tint of images formed using a toner having been made up using the same also comes reddish. In the present invention, even with the iron oxide particles being made into fine particles for the purpose of uniform dispersion, the use of iron oxide particles having no problem on the color tint as mentioned above has achieved the effect such that even the images formed using the toner having been made up using the same can have a sufficient black tint.

The black tint of images may be judged by visual observation of solid black images to judge whether or not the images are reddish. It is judged to be no problem when, in a solid black image with a transmission density of from 1.2 to 1.7, the values a* and b* in the measurement by the L*a*b* color system satisfy the relationship of the following expressions (3) and (4):

$$0 \leqq \text{value } a^* \leqq 0.5 \quad (3)$$

$$-0.5 \leqq \text{value } b^* \leqq 0.8 \quad (4)$$

(provided that the average particle diameter of the iron oxide particles is within the range of from 0.10 $\mu$m to 0.30 $\mu$m.)

A case in which the value a* is more than 0.5 is undesirable because strongly reddish images may be formed. A case in which the value b* is more than 0.8 is also undesirable because strongly yellowish or reddish images may be formed.

With regard to the lower limits of the values a* and b*, they are set as the lower-limit values where the iron oxide particles according to the present invention are used (as the black tint, there is no problem even when the values are lower than the-above ranges).

Making toner particles spherical makes it possible at least to lessen the area of-contact between the toner and the photosensitive member to improve the transfer efficiency. It, however, is very difficult to produce spherical toners in pulverization toners. Accordingly, a method has been contemplated in which corners of toner particles obtained by a pulverization process are rounded off to smooth their surfaces to make them closely spherical. This makes it possible to improve at least the transfer efficiency of toner, but there are various problems ascribable to the pulverization process. Thus, it has been necessary to make further studies.

Where the step of surface modification is additionally provided after the step of pulverization or classification in order to make toner particles spherical, the toner particle surfaces come treated with certain heat. Where the iron oxide particles are used as the colorant in the magnetic black toner, such treatment may lessen the iron oxide particles depositing on the toner particle surfaces, so that, when the toner is triboelectrically charged with a charge-providing member (developing sleeve), it tends to be charged in excess, where especially the black spots around line images may seriously occur.

Where toners made to have a small particle diameter are used, dot reproducibility is improved, but, with regard to fog and black spots around line images, these tend to occur seriously. This is considered due to the fact that toner particles called fine powder and ultrafine power and toner particles having the intended particle diameter are mixedly present because the toner comprised of fine particles is produced from crushed toner particles having a larger particle diameter. Namely, toner particles having different particle diameters have different charge characteristics and also have different adherence between individual particles. Hence, making the tone have a small particle diameter makes it conversely have a broad particle size distribution. Moreover, in the case of the magnetic black toner, this tendency is more remarkable when the iron oxide particles added stand non-uniformly dispersed, and may greatly influence especially the black spots around line images.

The toner particles obtained by pulverization may also repeatedly be classified to attain a sharp particle size distribution. It, however, is difficult to do so in actual production of toners.

According to studies made by the present inventors, in the magnetic black toner produced by pulverization, in order to keep the waste toner from coming and also achieve both the image quality and the black tint as an image grade even in a high-temperature and high-humidity environment and in a low-humidity environment by improving the transfer efficiency of toner required when toner images are transferred from the photosensitive member surface to the transfer material, it is important that:

(1) in the magnetic black toner having at least a binder resin and a magnetic material, the magnetic material comprises iron oxide particles which:

have an average particle diameter of from 0.10 μm to 0.30 μm;

contain titanium or a titanium compound in an amount of from 0.3% by weight to 1.5% by weight in terms of titanium, based on the total weight of the iron oxide particles; and have the ratio of the proportion of FeO to the total Fe content in 10% by weight from the particle surface, A %, to the proportion of FeO to the total Fe content in the remainder 90% by weight, B %, which satisfies $0.7 \leqq A/B \leqq 1.0$;

so as to improve their dispersibility in other materials to obtain a magnetic black toner promising a stable charge quantity and also having a sufficient degree of blackness; and (2) the magnetic black toner produced by pulverization has a weight-average particle diameter (X) of from 5 μm to 12 μm, and the toner has, in its particles of 3 μm or more in diameter, at least 90% by number of particles with a circularity of 0.900 or more and has an average circularity of from 0.940 to 0.970.

More preferably, the circularity in the particles of 3 μm or more in diameter may be controlled by the weight-average particle diameter of the toner and by the content of fine powder of less than 3 μm in particle diameter, whereby the same effect can be brought out in toner particles having different particle diameters.

The magnetic black toner of the present invention may preferably contain 40% by number or less of particles with particle diameter of 4.0 μm or less and 25% by volume or less of particles with particle diameter of 10.1 μm or more.

A case in which the magnetic black toner has a weight-average particle diameter of more than 12 μm is undesirable because there is a problem in making image quality higher which is due to the largeness of the toner particle diameter itself. A case in which the magnetic black toner has a weight-average particle diameter of less than 5 μm is also undesirable because the circularity of the toner and the state of dispersion of the iron oxide particles can not well be balanced to cause fog and black spots around line images seriously. The same applies also in cases in which the particles with particle diameter of 4.0 μm or less are more than 40% by number and particles with particle diameter of 10.1 μm or more are more than 25% by volume.

Namely, in the toner having the weight-average particle diameter of from 5 μm to 12 μm and containing 40% by number or less of the particles with particle diameter of 4.0 μm or less and 25% by volume or less of the particles with particle diameter of 10.1 μm or more, it is preferable that:

the toner has, in its particles of 3 μm or more in diameter, at least 90% by number of particles with a circularity (a) of 0.900 or more in number-based cumulative value, as determined from the following equation (1), and has an average circularity of from 0.940 to 0.970;

$$\text{Circularity } (a) = L_0/L \quad (1)$$

where $L_0$ represents the circumferential length of a circle having the same projected area as a particle image, and L represents the circumferential length of the particle image; and the magnetic material comprises iron oxide particles which:

1) have an average particle diameter of from 0.10 μm to 0.30 μm;

2) contain titanium or a titanium compound in an amount of from 0.3% by weight to 1.5% by weight in terms of titanium, based on the total weight of the iron oxide particles; and 3) have the ratio of the proportion of FeO to the total Fe content in 10% by weight from the particle surface, A %, to the proportion of FeO to the total Fe content in the remainder 90% by weight, B %, which satisfies the following expression (2):

$$0.7 \leqq A/B \leqq 1.0 \quad (2).$$

In the case when the toner has the range of particle diameter, circularity and specific iron oxide particles as shown above, the charging of the toner can be controlled with ease and the charging can be made uniform and made stable during running, without damaging the degree of blackness as the image grade. Also, in the case when the toner has the circularity as described above, it has been found that the toner can be improved in transfer efficiency. This is because, in the case of the toner having such a circularity, the area of contact between the toner and the photosensitive member can be made small, so that the adherent force may less act between the toner and the photosensitive member. Moreover, the toner particles have a specific surface area made smaller than any toners produced by conventional pulverization, and hence the toner has a smaller contact area between the toner particles themselves, and the toner powder can have a high bulk density, so that the conduction of heat at the time of fixing can be improved to also bring about the effect of improving fixing performance.

A case in which the particles with a circularity (a) of 0.900 or more in the particles of 3 μm or more in diameter of the magnetic black toner are present in a proportion smaller than 90% as number-based cumulative value is undesirable because the area of contact between the toner and the photosensitive member is so large that the adherent force of the toner particles may too greatly act on the photosensitive member to attain any sufficient transfer efficiency.

A case in which the magnetic black toner has an average circularity of less than 0.940 is undesirable because any sufficient transfer efficiency may not be attained, and a case in which it has an average circularity of more than 0.970 is also undesirable because, even with use of the magnetic material according to the present invention, the black spots around line images may not be kept from occurring seriously.

In addition, where toners have different particle diameters, the chargeability and specific surface area of the toners themselves may differ. Namely, a toner with small particle diameter has fine powder in a large content, has a high chargeability and also has a large specific surface area. Conversely, a toner with large particle diameter has coarse powder in a large content, has a low chargeability and also has a small specific surface area.

The transfer efficiency and charging can be controlled without any problem as long as the toner has the particle diameter and circularity within the above range. In order to always provide the same effect on toners having different particle diameters, the circularity may preferably be specified in greater detail as shown below.

The magnetic black toner of the present invention may preferably be a toner in which;

a) the relationship between cut rate Z and toner weight-average particle diameter X (μm) satisfies the following expression (5):

$$\text{Cut rate } Z \leqq 5.3 \times X \tag{5}$$

provided that the cut rate Z is represented by the following expression (3):

$$Z = (1 - B/A) \times 100 \tag{6}$$

where A is the particle concentration (number of particles/μl) of the whole measured particles as measured with a flow-type particle image analyzer FPIA-1000, manufactured by Toa Iyou Denshi K. K., and B is the particle concentration (number of particles/μl) of measured particles of 3 μm or more in circle-corresponding diameter; and in the particles of 3 μm or more in diameter of the toner and in the number-based circularity distribution of the circularity (a), the relationship between the number-based cumulative value Y of particles with a circularity (a) of 0.950 or more and the toner weight-average particle diameter X satisfies the following expression (7):

Number-based cumulative value Y of particles with a circularity (a) of 0.950 or more $$\geqq \exp 5.51 \times X^{-0.645} \tag{7}$$

provided that the toner weight-average particle diameter X is from 5.0 μm to 12.0 μm; or b) the relationship between the cut rate Z and the toner weight-average particle diameter X (μm) satisfies the following expression (8):

$$\text{Cut rate } Z > 5.3 \times X \tag{8}$$

and in the particles of 3 μm or more in diameter of the toner and in the number-based circularity distribution of the circularity (a), the relationship between the number-based cumulative value Y of particles with a circularity (a) of 0.950 or more and the toner weight-average particle diameter X satisfies the following expression (9):

Number-based cumulative value Y of particles with a circularity (a) of 0.950 or more $$\geqq \exp 5.37 \times X^{-0.545} \tag{9}$$

provided that the toner weight-average particle diameter X is from 5.0 μm to 12.0 μm.

Where, in the number-based cumulative value Y of particles with a circularity (a) of 0.950 or more in the particles of 3 μm or more in diameter of the toner, a) the relationship between the cut rate Z and the toner weight-average particle diameter X satisfies the expression:

$$\text{Cut rate } Z \leqq 5.3 \times X,$$

and preferably;

$$0 < \text{cut rate } Z \leqq 5.3 \times X;$$

but does not satisfy:

$$\text{Number-based cumulative value } Y \geqq \exp 5.51 \times X^{-0.645};$$

that is, where it satisfies:

$$\text{Number-based cumulative value } Y < \exp 5.51 \times X^{-0.645};$$

or where, in the number-based cumulative value Y of particles with a circularity (a) of 0.950 or more in the particles of 3 μm or more in diameter of the toner, b) the relationship between the cut rate Z and the toner weight-average particle diameter X satisfies the expression:

$$\text{Cut rate } Z > 5.3 \times X,$$

and preferably;

$$95 \geqq \text{cut rate } Z > 5.3 \times X;$$

but
does not satisfy:

$$\text{Number-based cumulative value } Y \geqq \exp 5.37 \times X^{-0.545};$$

that is, where it satisfies:

$$\text{Number-based cumulative value } Y < \exp 5.37 \times X^{-0.545};$$

the adhesion of toner to fixing members and so forth tends to more occur, so that the toner may have a poor fluidity and also the transfer efficiency may lower.

As one standard of the scattering in shape of particles having such a circularity, the circularity standard deviation SD may be used. In the present invention, the circularity standard deviation SD of the circularity may preferably be in the range of from 0.030 to 0.050.

The circularity referred to in the present invention is used as a simple method for expressing the shape of toner quantitatively. In the present invention, the shape of particles is measured with a flow type particle image analyzer FPIA-1000, manufactured by Toa Iyou Denshi K. K., and the circularity of particles thus measured is calculated according to the following equation (1). As also further shown in the following equation (10), the value found when the sum total of circularity of all particles measured is divided by the number of all particles is defined to be the average circularity.

$$\text{Circularity } (a) = L_0/L \tag{1}$$

wherein $L_0$ represents the circumferential length of a circle having the same projected area as a particle circle having the same projected area as a particle image, and L represents the circumferential length of the particle image.

$$\text{Average circularity } \bar{a} = \sum_{i=1}^{m} ai/m \tag{10}$$

The circularity standard deviation SD is calculated from the following equation (11), where the average circularity determined from the above equations (1) and (10) is represented by a, the circularity in each particle by ai, and the number of particles measured, by m.

Circularity standard deviation $$SD = \sum_{i=1}^{m} (a - ai)^2 / m^{1/2} \tag{11}$$

The circularity referred to in the present invention is an index showing the degree of particle surface unevenness of the toner particles. It is indicated as 1.00 when the toner particles are perfectly spherical. The more complicate the surface shape is, the smaller the value of circularity is. Also, the SD of circularity distribution in the present invention is an index showing the scattering. It indicates that, the smaller the numerical value is, the sharper distribution the toner particles have.

The measuring device "FPIA-1000" used in the present invention employs a calculation method in which, in calculating the circularity of each particle and thereafter calculating the average circularity and circularity standard deviation, particles are ordered according to the resultant circularity into classes in which circularities of 0.4 to 1.0 are divided into 61 division ranges, and the average circularity and circularity standard deviation are calculated using the center values and frequencies of divided points. Between the values of the average circularity and circularity standard deviation calculated by this calculation method and the values of the average circularity and circularity standard deviation calculated by the above calculation equation which uses the above circularity of each particle directly, there is only a very small accidental error, which is at a level that is substantially negligible. Accordingly, in the present invention, such a calculation method in which the concept of the calculation equation which uses the above circularity of each particle directly is utilized and is partly modified may be used, for the reasons of handling data, e.g., making the calculation time short and making the operational equation for calculation simple.

As a specific method for the measurement, 0.1 to 0.5 ml of a surface-active agent (preferably alkylbenzene sulfonate) as a dispersant is added to 100 to 150 ml of water from which any impurities have previously been removed. To this solution, about 0.1 to 0.5 g of a measuring sample is further added. The resultant dispersion in which the sample has been dispersed is subjected to dispersion treatment by means of an ultrasonic dispersion machine for about 1 to 3 minutes. Adjusting the dispersion concentration to 12,000 to 20,000 particles/$\mu$l and using the above flow type particle image analyzer, the circularity distribution of particles having circle-corresponding diameters of from 0.60 $\mu$m to less than 159.21 $\mu$m are measured. Incidentally, since the dispersion concentration is adjusted to 12,000 to 20,000 particles/$\mu$l, particle concentration high enough to be able to keep the precision of analyzer can be maintained.

The summary of measurement is described in a catalog of FPIA-1000 (an issue of June, 1995), published by Toa Iyou Denshi K. K., and in an operation manual of the measuring apparatus and Japanese Patent Application Laid-Open No. 8-136439, and is as follows:

The sample dispersion is passed through channels (extending along the flow direction) of a flat transparent flow cell (thickness: about 200 $\mu$m). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-corresponding diameter. The circularity of each particle is calculated from the projected area of the two-dimensional image of each particle and the circumferential length of the projected image according to the above equation for calculating the circularity.

The constitution of toner that is preferable in the present invention for achieving its objects is further described below in detail.

The iron oxide particles as the magnetic material used in the present invention may preferably be those composed chiefly of magnetite with a high FeO content (FeO-rich magnetite). In the following description, the magnetic material is described on magnetite particles, which are typical ones as the iron oxide particles. Also, when referred to as iron oxide particles or magnetite particles, they are meant to be any of individual particles or their gathering.

Stated specifically, the magnetite particles in the present invention are characterized in that titanium is contained in the particles and that the ratio A/B of the proportion (A %) of FeO to the total Fe content in 10% by weight from the particle surface to the proportion (B %) of FeO to the total Fe content in the remainder 90% by weight (hereinafter "surface-portion/interior FeO ratio" is from 0.7 to 1.0.

Iron oxide particles, in particular, FeO-rich magnetite particles obtained by reaction in aqueous solution are commonly obtained by oxidizing a ferrous hydroxide slurry prepared by mixing an aqueous ferrous salt solution and an alkali solution to neutralize. As to the surface-portion/interior FeO ratio of the magnetite particles obtained by such a known technique, as disclosed in Japanese Patent Application Laid-Open No. 2001-2426, it is approximately from 0.3 to 0.6 (the particle surface-vicinal layer with a thickness corresponding to 3.5% of a particle radius as described in this publication is substantially in agreement with 10% by weight from the particle surface in terms of weight as referred to in the present invention).

In contrast thereto, the iron oxide particles used in the present invention has the surface-portion/interior FeO ratio of from 0.7 to 1.0. Thus, the FeO content in the vicinity of the particle surface is sufficiently high. Hence, the iron oxide particles have a sufficiently high degree of blackness, and also are not affected by any deterioration with time of the degree of blackness even if their surfaces have been oxidized more or less.

If this surface-portion/interior FeO ratio is less than 0.7, the FeO content in the vicinity of the particle surface can not be said to be sufficient, and the particles may have a low degree of blackness, or, even with a high degree of blackness, may be magnetite particles which are inferior in respect of deterioration with time and have a poor environmental resistance. If on the other hand the surface-portion/interior FeO ratio is more than 1.0, though the degree of blackness and environmental resistance can be superior, the effect of the present invention can no longer be further improved even if the FeO content in the surface portion is made higher than is necessary. Taking account of more highly improving the degree of blackness and the environmental resistance, this surface-portion/interior FeO ratio may preferably be from 0.8 to 1.0, and more preferably from 0.9 to 1.0.

For the iron oxide particles used in the present invention, it is also important to contain titanium in the particles. The titanium in the whole particle may preferably be in a content of from 0.3 to 1.5% by weight in terms of titanium, based on the total weight of the iron oxide particles. In the present invention, the feature that the titanium is contained in the magnetite particles is greatly concerned in that the magnetite particles can have the surface-portion/interior FeO ratio of from 0.7 to 1.0. This will be detailed later. If the titanium in the whole particle is in a content less than 0.3% by weight, the titanium content in the vicinity of the particle surface tends to be so small that it may be difficult for the magnetite particles obtained by the reaction in aqueous solution, to be made to have the surface-portion/interior FeO ratio of from 0.7 to 1.0. If it is in a content more than 1.5% by weight, the titanium content in the vicinity of the particle surface tends to be excess, and the titanium content in the whole particle may be so excessively high as to cause faultiness in magnetic characteristics and other characteristics such as degree of blackness, hues and so forth, undesirably. This titanium in the whole particle may preferably be in a content of from 0.4 to 1.2% by weight, and more preferably from 0.4 to 0.8% by weight, in order to more lessen the titanium content in the whole particle and also to make control so that the surface-portion/interior FeO ratio does not lower.

The iron oxide particles used in the present invention may have an average particle diameter of from 0.10 $\mu$m to 0.30 $\mu$m. This is preferable in view of dispersibility, black tint and so forth. In order to more bring out the characteristic feature of the iron oxide particles used in the present invention, the iron oxide particles may more preferably be made to have an average particle diameter of from 0.10 $\mu$m to 0.20 $\mu$m, and still more preferably from 0.10 $\mu$m to 0.15 $\mu$m. A case in which the iron oxide particles have an average particle diameter of less than 0.10 $\mu$m is undesirable because such particles may cause faulty dispersion due to re-agglomeration or the like of the iron oxide in the toner, or the black tint of toner may be damaged even with use of the iron oxide particles used in the present invention. A case in which the iron oxide particles have an average particle diameter of more than 0.30 $\mu$m is ideal in respect of the black tint of toner, but is undesirable because such particles may be the cause of their poor dispersion in the toner particles.

The iron oxide particles used in the present invention may also be any of spherical, hexahedral and other polyhedral particles as long as they are in the form of particles. In view of the dispersibility in toner particles and the black tint, they may preferably be octahedral particles.

The iron oxide particles used in the present invention may also preferably have any of Al, Si, P, S, Cr, Mn, Co, Ni, Cu, Zn and Mg in a small total content. Such components are contained as inevitable components due to raw materials used when the magnetite particles are produced, or incorporated in the iron oxide particles by their addition as a means for improving dispersibility and fluidity. In the iron oxide particles used in the present invention, a better effect can readily be brought out when such components are in a smaller content, taking account of controlling the surface-portion/interior FeO ratio and maintaining high magnetic properties. Accordingly, they may preferably be in a content of 1% by weight or less, and more preferably 0.8% by weight or less.

The iron oxide particles used in the present invention may preferably have, in the measurement of degree of blackness and hues of powder according to JIS K5101-1991, a value L* of 20 or less, a value a* of 0.1 or less and a value b* of 0.1 or less as measured with a differential calorimeter. An instance where the value L* is more than 20, the value a* is more than 0.1 and the value b* is more than 0.1 is undesirable because the black tint in solid black images formed using a toner having been made up using such iron oxide particles may be damaged.

These iron oxide particles may preferably be those having a coercive force Hc of from 1.6 to 12.0 kA/m, a saturation magnetization $\sigma s$ of from 50 to 200 $Am^2/kg$ (preferably from 50 to 100 $Am^2/kg$) and a residual magnetization or of from 2 to 20 $Am^2/kg$, as magnetic properties under application of a magnetic field of 795.8 kA/m.

The iron oxide particles may be used in an amount of from 50 to 150 parts by weight, and preferably from 60 to 120 parts by weight, based on 100 parts by weight of the binder resin. A case in which the iron oxide particles are less than 50 parts by weight is undesirable because not only fog and black spots around line images may seriously occur but also, as the magnetic black toner, the black tint may be insufficient. A case in which the iron oxide particles are more than 150 parts by weight is undesirable because the toner may come not to well fly from the charge-providing member (developing sleeve) to cause a decrease in image density.

Next, with regard to how to produce the iron oxide particles used in the present invention, commonly available methods of producing magnetite particles may be used without any problem. A particularly preferred method is specifically described below.

The iron oxide particles used in the present invention may be produced in the following way: In a method in which iron oxide particles are produced by oxidizing a ferrous hydroxide slurry prepared by mixing an aqueous ferrous salt solution and an alkali solution to neutralize, a ferrous hydroxide slurry is used which is prepared by adding and mixing tetravalent titanium salt and/or titanate in the aqueous ferrous salt solution, while adjusting the pH of the aqueous ferrous salt solution to 1.5 or less and its temperature to 70° C. or below so that the tetravalent titanium salt and/or titanate may not deposit as titanium hydroxide.

Here, what is important is to adjust the pH of the aqueous ferrous salt solution to 1.5 or less and its temperature to 70° C. or below so that the tetravalent titanium salt and/or titanate may not deposit as titanium hydroxide, and then add and mix the tetravalent titanium salt and/or titanate in the aqueous ferrous salt solution.

The reason why the pH of the aqueous ferrous salt solution is adjusted to 1.5 or less and its temperature to 70° C. or below is that the tetravalent titanium salt and/or titanate to be added is/are made not to hydrolyze and deposit as titanium hydroxide. According to this method, the titanium component(s) with the valence of 4 is/are uniformly incorporated in the particles from the formation of nuclei of particles up to the completion of growth of final particles, so that the Fe(II) can stably be formed even at the particle surface portion.

The titanium salt and/or titanate to be added is/are adjusted so as to be in the content of from 0.3% by weight to 1.5% by weight in terms of titanium, based on the total weight of the final iron oxide particles.

What is usable as the ferrous salt may be any of ferrous sulfate, ferrous chloride and so forth without any particular limitations as long as it is a water-soluble salt. Also, what is usable as the titanium salt and titanate to be added may include titanium (IV) sulfate, titanium (IV) chloride, titanyl sulfate and titanyl nitrate.

Next, the aqueous ferrous salt solution containing the tetravalent titanium component(s) thus obtained and the alkali solution are mixed to neutralize to form the ferrous hydroxide slurry.

The amount of the alkali solution used when the ferrous hydroxide slurry is formed may be adjusted in accordance with the shape of the iron oxide particles to be obtained. Stated specifically, spherical particles are obtained when the pH of the ferrous hydroxide slurry is so adjusted as to be less than 8.0, hexahedral particles are obtained when it is so adjusted as to be 8.0 to 9.5, and octahedral particles are obtained when it is so adjusted as to be more than 9.5. Thus, the pH may appropriately be adjusted.

As the alkali solution, an aqueous alkali hydroxide solution such as an aqueous sodium hydroxide or potassium hydroxide solution may be used.

To obtain the iron oxide particles from the ferrous hydroxide slurry thus obtained, oxidation reaction may be carried out blowing a conventional oxygen-containing gas, preferably air, in the slurry, and the slurry in which the oxidation reaction has been completed may be filtered, followed by washing, drying and then pulverization treatment, all by conventional methods.

The binder resin used in the present invention may include vinyl resins, polyester resins and epoxy resins. In particular, vinyl resins and polyester resins are preferred in view of charging performance and fixing performance.

Monomers for the vinyl resins may include styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide; as well as α,β-unsaturated esters and diesters of dibasic acids. Any of these vinyl monomers may be used alone or in combination of two or more monomers.

Of these, monomers may preferably be used in such a combination that may give a styrene copolymer and a styrene-acrylic copolymer.

Also usable are polymers or copolymers cross-linked with a cross-linkable monomer as exemplified below.

It may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety is replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety is replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene(4)-2,2-bis(4-hydroxyphenyl)propane diacrylate, and the above compounds whose acrylate moiety is replaced with methacrylate; and polyester type diacrylate compounds as exemplified by MANDA (trade name; available from Nippon Kayaku Co., Ltd.).

As polyfunctional cross-linkable monomers, it may include pentaerythritol triacrylate, trimethylolethane triacrylate, trimethylolpropane triacrylate, tetramethylolmethane tetraacrylate, oligoester acrylate, and the above compounds whose acrylate moiety is replaced with methacrylate; triallylcyanurate, and triallyltrimellitate.

Any of these cross-linkable monomers may preferably be used in an amount of from 0.01 to 10 parts by weight, and more preferably from 0.03 to 5 parts by weight, based on 100 parts by weight of other monomer components.

Of these cross-linkable monomers, monomers preferably usable a resins for toners in view of fixing performance and anti-offset properties are aromatic divinyl compounds (in particular, divinylbenzene) and diacrylate compounds linked with a chain containing an aromatic group and an ether linkage.

In the present invention, a homopolymer or copolymer of vinyl monomers, polyester, polyurethane, epoxy resin, polyvinyl butyral, rosin, modified rosin, terpene resin, phenolic resin, an aliphatic or alicyclic hydrocarbon resin or an aromatic petroleum resin may optionally be mixed with the above binder resin.

In the case when a mixture of two or more types of resins are used as the binder resin, as a more preferable form, those having different molecular weights may preferably be mixed in a suitable proportion.

The binder resin may preferably have a glass transition temperature of from 45 to 80° C., and more preferably from 55 to 70° C., a number-average molecular weight (Mn) of from 2,500 to 50,000 and a weight-average molecular weight (Mw) of from 10,000 to 1,000,000.

As processes for synthesizing binder resins comprised of vinyl polymers or vinyl copolymers, any of polymerization processes such as bulk polymerization, solution polymerization, suspension polymerization and emulsion polymerization may be used. Where carboxylic acid monomers or acid anhydride monomers are used, it is preferable in view of properties of monomers to use bulk polymerization or solution polymerization.

As an example, the following process is available: Using a monomer such as dicarboxylic acid, dicarboxylic anhydride or dicarboxylic monoester, a vinyl copolymer may be obtained by bulk polymerization or solution polymerization. In the solution polymerization, the dicarboxylic acid or dicarboxylic monoester unit may partly be converted into an anhydride by designing conditions for distillation at the time of solvent distillation. Also, the vinyl copolymer obtained by bulk polymerization or solution polymerization may be subjected to heat treatment to convert it further into an anhydride. The acid anhydride may also partly be esterified with a compound such as an alcohol.

Conversely, the vinyl copolymer thus obtained may be subjected to hydrolysis treatment to cause its acid anhydride group to undergo ring opening so as to be partly made into a dicarboxylic acid.

Meanwhile, using a dicarboxylic acid monoester monomer, a vinyl copolymer obtained by suspension polymerization or emulsion polymerization may be subjected to heat treatment to convert it into an anhydride, or may be subjected to hydrolysis treatment to effect ring opening to obtain a dicarboxylic acid from an anhydride. A process may be used in which the vinyl copolymer obtained by bulk polymerization or solution polymerization is dissolved in a monomer and then a vinyl polymer or copolymer is obtained by suspension polymerization or emulsion polymerization, where part of the acid anhydride undergoes ring opening to obtain the dicarboxylic acid unit. At the time of polymerization, other resin may be mixed in the monomer, and the resin obtained may be subjected to heat treatment to convert it into an acid anhydride, or the acid anhydride may be esterified by ring-opening alcohol treatment by treating it with weakly alkaline water.

The dicarboxylic acid or dicarboxylic anhydride monomer is strongly alternatingly copolymerizable and hence, in order to obtain a vinyl copolymer in which functional groups such as anhydride or dicarboxylic acid have been dispersed at random, the following process is one of preferred processes. It is a process in which, using a dicarboxylic acid monoester monomer, a vinyl copolymer is obtained by solution polymerization, and this vinyl copolymer is dissolved in the monomer to effect suspension polymerization to obtain the binder resin. In this process, the whole or dicarboxylic acid monoester moiety can be converted into an acid anhydride by alcohol-removing ring closure to obtain an acid anhydride, controlling treatment conditions at the time of solvent distillation after the solution polymerization. At the time of suspension polymerization, the acid anhydride group undergoes hydrolysis ring opening and a dicarboxylic acid is obtained.

In conversion into an acid anhydride in the polymer, infrared absorption of carbonyl shifts to a higher wave number side than that of an acid or ester. Thus, the formation or disappearance of the acid anhydride can be ascertained.

In the binder resin thus obtained, the carboxyl group, the anhydride group and the dicarboxylic acid group are uniformly dispersed in the binder resin matrix, and hence they can provide the toner with a good charging performance.

As the binder resin, a polyester resin shown below is also preferred.

In the polyester resin, from 45 to 55 mol % in the all components are held by an alcohol component, and from 55 to 45 mol % by an acid component.

As the alcohol component, it may include polyhydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (B):

(B)

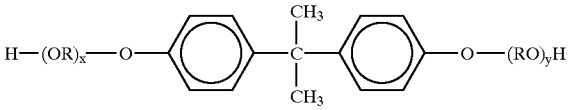

wherein R represents an ethylene group or a propylene group, x and y are each an integer of 1 or more, and an average value of x+y is 2 to 10;

also a diol represented by the following Formula (C).

(C)

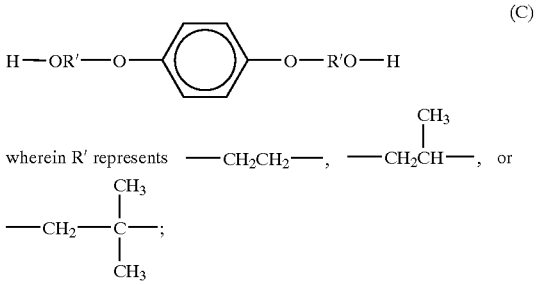

glycerol, sorbitol and sorbitan.

As a dibasic carboxylic acid component that holds 50 mol % or more of the whole acid component, it may include benzene dicarboxylic acids such as phthalic acid, terephthalic acid, isophthalic acid and phthalic anhydride, and anhydrides thereof; alkyldicarboxylic acids such as succinic acid, adipic acid, sebacic acid and azelaic acid, and anhydrides thereof, as well as succinic acid further substituted with an alkyl group or alkenyl group having 6 to 18 carbon atoms, or anhydrides thereof; unsaturated dicarboxylic acids such as fumaric acid, maleic acid, citraconic acid and itaconic acid, and anhydrides thereof. As a tribasic or higher carboxylic acid, it may include trimellitic acid, pyromellitic acid, benzophenonetetracarboxylic acid, and anhydrides thereof.

A particularly preferred alcohol component of the polyester resin is the bisphenol derivative represented by the above Formula (B). As the acid component, particularly preferred are dicarboxylic acids such as phthalic acid, terephthalic acid, isophthalic acid and anhydrides thereof, succinic acid, n-dodecenylsuccinic acid or anhydrides thereof, fumaric acid, maleic acid and maleic anhydride; and tricarboxylic acids such as trimellitic acid or anhydrides thereof. This is because the toner using as the binder resin the polyester resin obtained from these acid component and alcohol component has good fixing performance and superior anti-offset properties as a toner for heat-roller fixing.

The polyester resin may preferably have an acid value of 90 mg·KOH/g or less, and more preferably 50 mg·KOH/g or less, and may preferably have an OH value (hydroxyl value) of 50 mg·KOH/g or less, and more preferably 30 mg·KOH/g or less. This is because a polyester resin having a large number of terminal groups in the molecular chain may make the fixing performance of toner have a great environmental dependence.

The polyester resin may preferably have a glass transition temperature of from 50 to 75° C., and more preferably from 55 to 65° C., and also may preferably have a number-average molecular weight (Mn) of from 1,500 to 50,000, and more preferably from 2,000 to 20,000. It may preferably have a weight-average molecular weight (Mw) of from 6,000 to 100,000, and more preferably from 10,000 to 90,000.

The toner of the present invention, in order to make its charging performance more stable, may optionally make use of a charge control agent. The charge control agent may preferably be used in an amount of from 0.5 to 10 parts by weight based on 100 parts by weight of the binder resin. A case in which it is less than 0.5 part by weight is undesirable because any sufficient charge characteristics may not be obtained. A case in which it is more than 10 parts by weight is undesirable because it may have a poor compatibility with other materials or may be charged in excess in an environment of low humidity.

The charge control agent may include the following.

As charge control agents capable of controlling the toner to be negatively chargeable, organometallic complexes or chelate compounds are available, which include monoazo metal complexes, metal complexes of aromatic hydroxycarboxylic acids and metal complexes of aromatic dicarboxylic acids. Besides, they include copolymers of styrene monomers and acrylic monomers with sulfonic-acid-containing acrylamide monomers (sulfonic-acid-containing copolymers), aromatic hydroxycarboxylic acid, aromatic mono- or polycarboxylic acids and metal salts thereof, anhydrides thereof or esters thereof, and phenolic derivatives such as bisphenol.

Charge control agents capable of controlling the toner to be positively chargeable include Nigrosine and its modified products, modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts of these, and, as chelate pigments of these, triphenylmethane dyes and lake pigments of these (lake-forming agents may include tungstophosphoric acid, molybdophosphoric acid, tungstomolybdophosphoric acid, tannic acid, lauric acid, gallic acid, ferricyanic acid and ferrocyanic compounds); copolymers of methacryloyloxytrimethylammonium sulfate with vinyl monomers copolymerizable with this; metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate.

In the present invention, at least one kind of release agent may optionally be incorporated in the toner particles. The release agent may include the following.

Aliphatic hydrocarbon waxes such as low-molecular weight polyethylene, low-molecular weight polypropylene, microcrystalline wax and paraffin wax, and oxides of aliphatic hydrocarbon waxes such as polyethylene wax oxide, and block copolymers of these; waxes composed chiefly of a fatty ester, such as carnauba wax, sazol wax and montanic acid ester wax; and those obtained by subjecting part or the whole of a fatty ester to deoxydation treatment, such as deoxidized carnauba wax. It may also include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; long-chain alkyl alcohols; polyhydric alcohols such as sorbitol; fatty amides such as linolic acid amide, oleic acid amide and lauric acid amide; saturated fatty bisamides such as methylenebis (stearic acid amide), ethylenebis (capric acid amide), ethylenebis (lauric acid amide) and hexamethylenebis (stearic acid amide); unsaturated fatty amides such as ethylenebis (oleic acid amide), hexamethylenebis (oleic acid amide), N,N'-dioleyladipic acid amide and N,N'-dioleylsebacic acid amide; aromatic bisamides such as m-xylenebis(stearic acid amide) and N,N'-distearylisophthalic acid amide; fatty metal salts (what is commonly called metal soap) such as calcium stearate, calcium laurate, zinc stearate and magnesium stearate; grafted waxes obtained by graft-polymerizing vinyl monomers such as styrene or acrylic acid to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

The release agent may preferably be used in an amount of from 0.1 to 20 parts by weight, and more preferably from 0.5 to 10 parts by weight, based on 100 parts by weight of the binder resin.

Any of these release agents may be incorporated into the binder resin usually by a method in which a resin is dissolved in a solvent and, raising the temperature of the resin solution, the release agent is added and mixed therein with stirring, or a method in which they are mixed at the time of kneading.

The inorganic fine powder used in the present invention serves as a fluidity improver, and is an agent which can improve the fluidity of the toner by its external addition to toner particles, as seen in comparison before and after its addition. For example, it may include fluorine resin powders such as fine vinylidene fluoride powder and fine polytetrafluoroethylene powder; fine silica powders such as wet-process silica and dry-process silica; fine titanium oxide powder; fine alumina powder; and treated silica powders and the like obtained by subjecting these fine powders to surface treatment with a silane coupling agent, a titanium coupling agent or a silicone oil.

A preferred inorganic fine powder (fluidity improver) is fine powder produced by vapor phase oxidation of a silicon halide, which is what is called dry-process silica or fumed silica. For example, it utilizes heat decomposition oxidation reaction in oxyhydrogen frame of silicon tetrachloride gas. The reaction basically proceeds as follows.

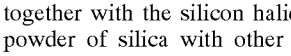

$$SiCl_4+2H_2+O_2 \rightarrow SiO_2+4HCl$$

In this production step, it is also possible to use other metal halide such as aluminum chloride or titanium chloride together with the silicon halide to obtain a composite fine powder of silica with other metal oxide. The silica also includes such a powder. As to its particle diameter, it is preferable to use fine silica powder having an average primary particle diameter within the range of from 0.001 to 2 $\mu$m, and particularly preferably within the range of from 0.002 to 0.2 $\mu$m.

Commercially available fine silica powders produced by the vapor phase oxidation of silicon halides, include, e.g., those which are on the market under the following trade names.

Aerosil 130, 200, 300, 380, TT600, MOX170, MOX80, COK84 (Aerosil Japan, Ltd.);

Ca-O-SiL M-5, MS-7, MS-75, HS-5, EH-5 (CABOT CO.);

Wacker HDK N20, V15, N20E, T30, T40 (WACKER-CHEMIE GMBH);

D-C Fine Silica (Dow-Corning Corp.); and

Fransol (Fransil Co.).

It is also preferable to use treated fine silica powder obtained by hydrophobic-treating the fine silica powder produced by vapor phase oxidation of a silicon halide. In the treated fine silica powder, a fine silica powder is particularly preferred which has been so treated that its hydrophobicity as measured by a methanol titration test shows a value within the range of from 30 to 80.

As methods for making hydrophobic, the fine silica powder may be made hydrophobic by chemical treatment with an organosilicon compound capable of reacting with or physically adsorbing the fine silica powder. As a preferable method, the fine silica powder produced by vapor phase oxidation of a silicon halide may be treated with an organosilicon compound.

The organosilicon compound may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals. It may further include silicone oils such as dimethylsilicone oil. Any of these may be used alone or in the form of a mixture of two or more types.

As the inorganic fine powder (fluidity improver), one having a specific surface area of 30 $m^2/g$ or more, and preferably 50 $m^2/g$ or more, as measured by the BET method utilizing nitrogen absorption provides good results. The inorganic fine powder may preferably be used in an amount of from 0.01 to 8 parts by weight, and preferably from 0.1 to 4 parts by weight, based on 100 parts by weight of the toner. A case in which it is less than 0.01 part by weight is undesirable because the improvement in fluidity as the intended effect may not be achieved. A case in which it is more than 8 parts by weight is undesirable because fog may seriously occur.

In the magnetic black toner of the present invention, any inorganic fine powder other than the foregoing may be added to provide chargeability and fluidity in addition to an abrasion effect, and as a cleaning auxiliary. Such an additional inorganic fine powder is an agent which can improve the effect by its external addition to toner particles, as seen in comparison before and after its addition. The additional inorganic fine powder usable in the present invention may include titanates and/or silicates of magnesium, zinc, cobalt, manganese, strontium, cerium, calcium, barium or the like. In particular, strontium titanate ($SrTiO_3$), calcium titanate ($CaTiO_3$), strontium silicate ($SrSiO_3$) and barium titanate ($TiBaO_3$) are preferred because the effect of the present invention can more be brought out.

The inorganic fine powder used in the present invention may preferably be, e.g., a powder obtained by forming a material by sintering, and mechanically pulverizing the material, followed by air classification to have the desired particle size distribution.

The inorganic fine powder may be added in an amount of from 0.1 to 10 parts by weight, and preferably from 0.2 to 8 parts by weight, based on 100 parts by weight of the toner particles.

As methods of producing the magnetic black toner of the present invention, there are no particular limitations as long as the desired circularity and particle diameter described previously can be attained by means of any commonly available production apparatus.

Stated specifically, the binder resin and the magnetic material (iron oxide particles) are, with addition of the charge control agent, the release agent and so forth as other additives, dry-process mixed by means of a mixing machine such as a Henschel mixer or a ball mill, and the mixture formed is melt-kneaded by means of a heat kneading machine such as a kneader, a roll mill or an extruder to make resins melt one another. The melt-kneaded product obtained is cooled to solidify, and thereafter the solidified product is crushed. Then the crushed product obtained is pulverized by means of an impact-type air grinding machine such as Jet Mill, Micron Jet or IDS-type Mill, or a mechanical grinding machine such as Criptron, Turbo Mill or Inomizer, and the pulverized product thus obtained is classified using an air classifier or the like to have the desired particle size distribution, followed by external addition and mixing of the inorganic fine powders such as a fluidizing agent and an abrasive. Thus, the magnetic black toner of the present invention can be obtained.

The magnetic black toner of the present invention may also be made to have the desired circularity by designing pulverization conditions when the crushed product is pulverized, or by using a surface-modifying apparatus after the pulverization or classification. It is more preferable to use the mechanical grinding machine, in which productivity and pulverization conditions can be set with ease.

Stated specifically, the use of such a mechanical grinding machine enables control of the circularity with ease, such that, when the circularity of the toner should be made higher, the apparatus internal load may be made higher and the apparatus internal temperature may be raised, and, conversely, when the circularity of the toner should be made lower, the apparatus internal load may be made lower and the apparatus internal temperature may be dropped.

Various physical properties shown in the following Examples are measured by methods as described below.

(1) Measurement of Particle Size Distribution

The particle size distribution can be measured by various means. In the present invention, it is measured with a Coulter counter Multisizer.

A Coulter counter Multisizer Model II (manufactured by Coulter Electronics, Inc.) is used as a measuring instrument. An interface (manufactured by Nikkaki K. K.) that outputs number distribution and volume distribution and a personal computer CX-1 (manufactured by CANON INC.) are connected. As an electrolytic solution, an aqueous 1% NaCl solution is prepared using guaranteed or first-grade sodium chloride. Measurement is made by adding as a dispersant from 0.1 to 5 ml of a surface-active agent (preferably alkylbenzenesulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Measurement is made with the above Coulter counter Multisizer Model II, using as an aperture an aperture of 100 $\mu$m when toner's particle diameter is measured and an aperture of 13 $\mu$m when inorganic fine powder's particle diameter is measured. The volume and number of the toner and inorganic fine powder are measured and the volume distribution and number distribution are calculated. Then, the weight-based, weight-average particle diameter determined from the volume distribution is determined.

(2) Measurement of Melting Point of Wax

Measured according to ASTM D3418-82, using a differential thermal analyzer (DSC measuring instrument) DSC-7, manufactured by Perkin Elmer Co. A sample for measurement is precisely weighed in an amount of 2 to 10 mg. This sample is put in a pan made of aluminum and an empty aluminum pan is used as reference. Measurement is made in a normal-temperature and normal-humidity environment at a heating rate of 10° C./min within the measuring temperature range of from 30 to 200° C. In the course of this heating, a main-peak endothermic peak in the temperature range of from 30 to 200° C. is obtained. The temperature at this endothermic main peak is regarded as the melting point of the wax.

(3) Measurement of Glass Transition Point (Tg)

Measured according to ASTM D3418-82, using a differential thermal analyzer (DSC measuring instrument) DSC-7, manufactured by Perkin Elmer Co. A sample for measurement is precisely weighed in an amount of 5 to 20 mg, preferably 10 mg.

This sample is put in a pan made of aluminum and an empty aluminum pan is used as reference. Measurement is made in a normal-temperature and normal-humidity environment at a heating rate of 10° C./min within the measuring temperature range of from 30 to 200° C.

In the course of this heating, a main-peak endothermic peak in the temperature range of from 40 to 100° C. is obtained. The point at which the line at a middle point of the base line before and after the appearance of the endothermic peak thus obtained and the differential thermal curve intersect is regarded as the glass transition point Tg.

(4) Measurement of Molecular Weight Distribution of Binder Resin Material

Molecular weight of a chromatogram is measured by GPC (gel permeation chromatography) under the following conditions.

Columns are stabilized in a heat chamber of 40° C. To the columns kept at this temperature, tetrahydrofuran (THF) as a solvent is flowed at a flow rate of 1 ml per minute. A sample is dissolved in THF, and thereafter filtered with a filter of 0.2 $\mu$m in pore size, and the resultant filtrate is used as a sample. From 50 to 200 $\mu$l of a THF sample solution of resin which has been adjusted to have a sample concentration of form 0.05 to 0.6% by weight is injected thereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Pressure Chemical Co. or Toso Co., Ltd., and to use at least about 10 standard polystyrene samples. An RI (refractive index) detector is used as a detector.

As columns, in order to make precise measurement in the region of molecular weight from 1,000 to 2,000,000, it is desirable to use a plurality of commercially available polystyrene gel columns in combination. For example, they may preferably comprise a combination of $\mu$-Styragel 500, 1,000, 10,000 and 100,000, available from Waters Co., and Shodex KA-801, KA-802, KA-803, KA-804, KA-805, KA-806 and KA-807, available from Showa Denko K. K.

EXAMPLES

The present invention is described below in greater detail by giving Examples and Comparative Example of the invention.

Iron Oxide Particles

Production Example 1: M-1

In 50 liters of an aqueous 2 mol/l ferrous sulfate solution, 5 liters of an aqueous 0.14 mol/l titanyl sulfate solution was mixed under conditions of pH 1 and temperature 50° C., and the mixture formed was thoroughly stirred. The titanium-salt-containing aqueous ferrous sulfate solution obtained and 43 liters of an aqueous 5 mol/l sodium hydroxide solution were mixed to obtain a ferrous hydroxide slurry. The pH of this ferrous hydroxide slurry was maintained to 12, and air was blown into the slurry at 85° C. to carry out oxidation reaction. The resultant slurry containing magnetite particles were filtered, followed by washing, drying and then pulverization, all by conventional methods, to obtain iron oxide particles M-1.

The iron oxide particles thus obtained were analyzed by the method shown below, to obtain the data shown in Table 1.

(a) Average Particle Diameter

The particles were photographed on a scanning electron microscope (30,000 magnifications), and their average particle diameter was calculated as Feret's diameter.

(b) Magnetic Properties

Measured with a vibrating-sample type magnetometer VSM-P7, manufactured by Toei Kogyo K. K., under an external magnetic field of 796 kA/m.

(c) Surface-Portion/Interior FeO Ratio twenty-five g of a sample was added to 3.8 liters of deionized water. Keeping 35 to 40° C. in a water bath, these were stirred at a stirring rate of 200 rpm. To the slurry thus formed, 1,250 ml of an aqueous hydrochloric acid solution (deionized water) in which 424 ml of a guaranteed hydrochloric-acid reagent was kept dissolved was added to start dissolution.

Fifty ml of the solution being formed was sampled at intervals of 10 minutes from the start of dissolution until the solution was completely formed to become transparent, and the solution formed was filtered with a 0.1 μm membrane filter to collect a filtrate.

Of the filtrate thus collected, a 25 ml portion was subjected to ICP (inductive coupled plasma) spectrometry to determine the iron element.

Iron element dissolution percentage (%)=((iron element concentration in sample collected (mg/l))/(iron element concentration when dissolved completely (mg/l)))×100

To know the FeO content in each sample, the sample was adjusted with addition of about 75 ml of deionized water in the remaining 25 ml of the sample, followed by addition of sodium diphenylaminesulfonate as an indicator. Oxidation-reduction titration was made using 0.1 N potassium dichromate to determine the titer, and at that time the point at which the sample colored in bluish violet was regarded as the end point. The proportion (% by weight) of FeO to the iron element was found according to the following equation.

FeO(% by weight)=((Fe(II)(mg/l) determined from titer×71.85)/(55.85/iron element quantity (mg/l) in sample))×100

As to the proportion of FeO to the total Fe content in 10% by weight from the particle surface and the proportion of FeO to the total Fe content in the remainder 90% by weight, the amount of FeO contained in each portion was determined by its proportion (% by weight) to the amount of Fe contained in each portion. Then, the surface-portion/interior FeO ratio was found according to the following equation.

Surface-portion/interior FeO ratio=(proportion of FeO to total Fe content in 10% by weight from particle surface)/(proportion of FeO to total Fe content in the remainder 90% by weight)

(d) Measurement of Content of Ti Element in Iron Oxide Particles

The sample was dissolved, and each element was measured by plasma spectrometry (ICP).

Iron Oxide Particles

Production Examples 2 to 6: M-2 to M-6

Iron oxide particles M-2, M-3, M-4, M-5 and M-6, respectively, were obtained in the same manner as in Iron Oxide Particles Production Example 1 except that the aqueous titanyl sulfate solution was added in different quantities. Also, when M-4 was produced, vacuum drying was employed as drying conditions to attempt to make the surface FeO content larger. Results of analyses of the iron oxide particles obtained were as shown in Table 1.

Iron Oxide Particles

Production Examples 7 to 10: M-7 to M-10

Iron oxide particles M-7, M-8, M-9 and M-10, respectively, were obtained in the same manner as in Iron Oxide Particles Production Example 1 except that air flow rate, reaction temperature and reaction time were changed. Results of analyses of the iron oxide particles obtained were as shown in Table 1.

Iron Oxide Particles

Production Example 11: M-11

Iron oxide particles M-11 were obtained in the same manner as in Iron Oxide Particles Production Example 1 except that the aqueous titanyl sulfate solution was not added. Results of analysis of the iron oxide particles obtained were as shown in Table 1.

Iron Oxide Particles

Production Example 12: M-12

In 50 liters of an aqueous 2 mol/l ferrous sulfate solution, 5 liters of an aqueous 0.14 mol/l titanyl sulfate solution was mixed under conditions of pH 2.5 and temperature 75° C., and the mixture formed was thoroughly stirred. The titanium-salt-containing aqueous ferrous sulfate solution obtained and 43 liters of an aqueous 5 mol/l sodium hydroxide solution were mixed to obtain a ferrous hydroxide slurry. The pH of this ferrous hydroxide slurry was maintained to 12, and air was blown into the slurry at 85° C. to carry out oxidation reaction. The resultant slurry containing magnetite particles were filtered, followed by washing, drying and then pulverization, all by conventional methods, to obtain iron oxide particles M-12. Results of analysis of the iron oxide particles obtained were as shown in Table 1.

Example 1

| | (by weight) |
|---|---|
| Binder resin (polyester resin) (Tg: 58° C.; acid value: 22 mg · KOH/g; hydroxyl value: 30 mg · KOH/g; molecular weight, Mp: 6,500, Mn: 3,000 and Mw: 52,000) | 100 parts |
| Iron oxide particles M-1 (average particle diameter: 0.12 μm; characteristics under application of magnetic field of 795.8 kA/m, Hc: 11.6 kA/m; σs: 84.6 $Am^2/kg$ and σr: 15.9 $Am^2/kg$) | 90 parts |
| Azo-type iron complex compound | 2 parts |
| Low-molecular-weight ethylene-propylene copolymer | 3 parts |

The materials formulated as shown above were thoroughly mixed by means of a Henschel mixer (FM-75 Type, manufactured by Mitsui Miike Engineering Corporation), and thereafter kneaded using a twin-screw kneader (PCM-30 Type, manufactured by Ikegai Corp.) set to a temperature of 130° C. The kneaded product obtained was cooled, and then crushed by means of a hammer mill to a size of 1 mm or less to obtain a powder material A (crushed product), a powder material for toner production.

The powder material A was pulverized by means of Turbo Mill Model T-250, a mechanical grinding machine manufactured by Turbo Kogyo K. K., setting the crushed-product feed rate to 21 kg/hr., and so controlling the inlet temperature and outlet temperature of the mechanical grinding machine as to be −10° C. and 47° C., respectively, to obtain a pulverized product having a weight-average particle diameter of 6.6 μm and containing 53% by number of particles of 4.0 μm or less in particle diameter and 5.4% by volume of particles of 10.1 μm or more in particle diameter.

Next, this pulverized product was classified by means of an air classifier to obtain a classified product B-1 having a weight-average particle diameter of 6.5 μm and containing 20.5% by number of particles of 4.0 μm or less in particle diameter and 3.8% by volume of particles of 10.1 μm or more in particle diameter.

To 100 parts by weight of this classified product B-1, 1.2 parts by weight of hydrophobic fine silica powder (BET specific surface area: 300 $m^2/g$) was externally added by means of a Henschel mixer to obtain a toner (a) for evaluation.

This toner had a weight-average particle diameter of 6.5 μm and contained 21.3% by number of particles of 4.0 μm or less in particle diameter and 3.8% by volume of particles of 10.1 μm or more in particle diameter. As a result of measurement with FPIA-1000, the toner was found to have an average circularity of 0.953 and contain 95.7% by number of particles with a circularity (a) of 0.900 or more and 78.4% by number of particles with a circularity (a) of 0.950 or more.

The particle concentration A before the cut of particles of 3 μm or smaller (the whole particles) was 15,209.7 particles/μl, and the particle concentration B of measured particles of 3 μm or larger was 13,028.3 particles/μl.

Evaluation 1

Three hundred and eighty g of the toner (a) for evaluation was put in a developing assembly of a copying machine IR6000, manufactured by CANON INC., having a charging-before-transfer assembly (post-charging assembly), and was left overnight (12 hours or more) in a high-temperature and high-humidity chamber (32.5° C./85% RH). After the weight of the developing assembly was measured, the developing assembly was set in the IR6000, and its developing sleeve was rotated for 3 minutes. Here, the cleaner part and waste-toner collection part in the main body were first detached and their weight was previously measured. Using a test chart having a print percentage (image area percentage) of 6%, images were reproduced on 500 sheets to evaluate toner transfer efficiency. The transfer efficiency A of the toner (a) for evaluation was found to be 90%.

The transfer efficiency was calculated according to the following calculation equation.

Transfer efficiency (%)=((weight loss of developing assembly−(weight gain at cleaner part+weight gain at waste-toner collection part))/weight loss of developing assembly)×100

Evaluation 2

Using the toner (a) for evaluation, the transfer efficiency was measured in the same manner as in Evaluation 1 except that the charging-before-transfer assembly (post-charging assembly) was removed. The transfer efficiency B of the toner (a) for evaluation was found to be 87%.

Evaluation 3

After the above transfer efficiency was measured, the copying machine was moved to a normal-temperature and low-humidity chamber (23° C./50% RH). Thereafter, the toner (a) for evaluation was supplied to the developing assembly in the mode of main-body installation. Then, using a test chart having a print percentage (image area percentage) of 4%, images were reproduced on 2,000 sheets, where the transmission density of solid black images was so adjusted as to be 1.7, and solid black images were reproduced on 3 sheets of A3-size paper. Color tone of the solid black images reproduced on the third sheet was measured.

The color tone was quantitatively measured according to the definition of the color system standardized by Commission Internationale de l'Eqlairage (CIE, or International Commission on Illumination) in 1976. A spectrophotometer Type 938, manufactured by X-Rite Co., was used as a measuring instrument. As a light source for observation, the C light source was used, and the visual-field angle was set to 2°. As the result of measurement, the value a* was found to be 0.36, the value b* −0.03 and the value L* 21.1. At the same time, asking ten people participating in the development of copying machines and the development of toners to visually observe the images measured in the above, the black tint was evaluated. As the result, all ten people answered that the images had a sufficient black tint. Evaluation ranks are shown below.

AA: All ten people judged the images to be no problem.

A: Eight people or more judged the images to be no problem.

B: Six people or more judged the images to be no problem.

C: Five people or more judged the images to be fairly reddish.

D: Seven people or more judged the images to be fairly reddish.

Evaluation 4

After the above color tone was measured, the copying machine was moved to a normal-temperature and low-humidity chamber (23° C./5% RH). Then, the developing assembly was taken outside the copying machine and was left for 5 days. Thereafter, the developing assembly was set in IR6000, and its developing sleeve was rotated for 1 minute. Using a test chart having a print percentage (image area percentage) of 3%, images were reproduced on 1,000 sheets to evaluate image quality on the basis of fog at white areas on the test charge and how black spots appeared around character images. The fog was less than 0.3% from the initial stage to 1,000th sheet, which was on the level of no problem. With regard to the black spots around character images, too, the images were magnified with a loupe to find that the images stood almost free of them.

Evaluation ranks are shown below. Using a fog-measuring, reflection measuring instrument REFLECTOMETER (manufactured by Tokyo Denshoku K. K.), the reflectance at the white areas of the above images and that of virgin paper were measured, and a difference between the both is regarded as fog. Reflectance of virgin paper−reflectance at image white areas=fog (%)

AA: Fog is less than 0.3%.

A: Fog is 0.3% to less than 1.0%.

B: Fog is 1.0% to less than 2.0%.

C: Fog is 2.0% to less than 2.5%.

D: Fog is 2.5% or more.

To examine how toner black spots appeared around character images, characters on the image sheets were magnified with a loupe to make judgment by visual observation.

AA: Any toner black spots are not seen around character images.

A: Very slight toner black spots can be seen around character images.

B: Toner black spots are seen around character images, but lines are clear.

C: Toner black spots are present around character images in a large number.

D: Toner black spots are present around character images in a large number, and also lines are not clear.

Evaluation 5

After the above fog was measured, the copying machine was moved to a high-temperature and high-humidity chamber (32.5° C./85% RH). Then, the developing assembly was taken outside the copying machine and was left for 2 days. Thereafter, the developing assembly was set in IR6000, and its developing sleeve was rotated for 3 minutes. Using a test chart having a print percentage (image area percentage) of 4%, images were reproduced on 100,000 sheets. Image density at black areas on the test chart was measured to examine how the image density shifted during running. As the result, the image density was found to be 1.45 at the initial stage and came to 1.43 on the last sheet (100,000th sheet), showing very stable results of ΔDmax=0.02. Evaluation ranks are shown below.

Here, ΔDmax=(initial image density)−(running−finish (100,000th sheet) image density).

AA: ΔDmax is less than 0.05.

A: ΔDmax is 0.05 to less than 0.10.

B: ΔDmax is 0.10 to less than 0.25.

C: ΔDmax is 0.25 to less than 0.40.

D: ΔDmax is 0.40 or more.

Example 2

The powder material A (crushed product) prepared in Example 1 was pulverized by means of an I-2 type mill manufactured by Nippon Pneumatic Kogyo K. K.), setting the crushed-product feed rate to 1.5 kg/hr and the pulverization pressure at 2 kg Pa, and also so setting that any toner crushed product not pulverized into particles with the stated particle diameter was again returned to the grinding machine, to obtain a pulverized product having a weight-average particle diameter of 7.4 μm and containing 49% by number of particles of 4.0 μm or less in particle diameter and 9.4% by volume of particles of 10.1 μm or more in particle diameter.

Next, the pulverized product thus obtained was classified by means of an air classifier to obtain a classified product B-2 having a weight-average particle diameter of 7.4 μm and containing 15.2% by number of particles of 4.0 μm or less in particle diameter and 6.7% by volume of particles of 10.1 μm or more in particle diameter.

To 100 parts by weight of this classified product B-2, 1.0 part by weight of hydrophobic fine silica powder (BET specific surface area: 300 $m^2/g$) and 4.0 parts by weight of strontium titanate (average particle diameter: 1.8 μm) were externally added by means of a Henschel mixer to obtain a toner (b) for evaluation. This toner had particle size as shown in Table 2, and circularity as shown in Table 3.

The toner (b) for evaluation was evaluated in the same manner as in Example 1 to obtain the results shown in Tables 4 and 5.

Example 3

The powder material A (crushed product) prepared in Example 1 was pulverized by means of an I-2 type mill manufactured by Nippon Pneumatic Kogyo K. K.), setting the crushed-product feed rate to 5.5 kg/hr and the pulverization pressure at 6 kg Pa, and also so setting that any toner crushed product not pulverized into particles with the stated particle diameter was again returned to the grinding machine, to obtain a pulverized product having a weight-average particle diameter of 7.2 μm and containing 53.8% by number of particles of 4.0 μm or less in particle diameter and 10.1% by volume of particles of 10.1 μm or more in particle diameter.

The pulverized product thus obtained was further passed through a 62° C. heat sphering apparatus, followed by classification by means of an air classifier to obtain a classified product B-3 having a weight-average particle diameter of 7.5 μm and containing 16.9% by number of particles of 4.0 μm or less in particle diameter and 8.2% by volume of particles of 10.1 μm or more in particle diameter.

To 100 parts by weight of this classified product B-3, 1.0 part by weight of hydrophobic fine silica powder (BET specific surface area: 300 $m^2/g$) and 4.0 parts by weight of strontium titanate (average particle diameter: 1.8 μm) were externally added by means of a Henschel mixer to obtain a toner (c) for evaluation. This toner (c) had particle size as shown in Table 2, and circularity as shown in Table 3.

The toner (c) for evaluation was evaluated in the same manner as in Example 1 to obtain the results shown in Tables 4 and 5.

Examples 4 to 8

Toners (d), (e), (f), (g) and (h) for evaluation were obtained in the same manner as in Example 1 except that the iron oxide particles M-3, M-4, M-5, M-8 and M-9, respectively, were used in place of the iron oxide particles M-1.

These toners each had particle size as shown in Table 2, and circularity as shown in Table 3.

The toners (d), (e), (f), (g) and (h) for evaluation were evaluated in the same manner as in Example 1 to obtain the results shown in Tables 4 and 5.

Examples 9 to 11

The powder material A (crushed product) prepared in Example 1 was pulverized by means of Turbo Mill Model T-250, manufactured by Turbo Kogyo K. K.), setting as desired the crushed-product feed rate and the inlet temperature and outlet temperature of the mechanical grinding machine, to obtain pulverized products having different particle sizes and circularities, followed by classification by means of an air classifier to obtain classified products. Thereafter, to 100 parts by weight of each of the classified products, 0.5 to 1.2 parts by weight of hydrophobic fine silica powder (BET specific surface area: 300 $m^2/g$) was externally added by means of a Henschel mixer to obtain toners (i), (j) and (k) for evaluation. These toners each had particle size as shown in Table 2, and circularity as shown in Table 3.

The toners (i), (j) and (k) for evaluation were evaluated in the same manner as in Example 1 to obtain the results shown in Tables 4 and 5.

Examples 12 to 15

Toners (l), (m), (n) and (o) for evaluation were obtained in the same manner as in Example 1 except that the iron oxide particles M-1 were added in amounts changed to 50, 75, 120 and 150 parts by weight, respectively. These toners each had particle size as shown in Table 2, and circularity as shown in Table 3.

The toners (l), (m), (n) and (o) for evaluation were evaluated in the same manner as in Example 1 to obtain the results shown in Tables 4 and 5.

Comparative Example 1

A comparative toner (p) for evaluation was prepared in the same manner as in Example 1 except that the iron oxide particles M-11 was used in place of the iron oxide particles M-1. This toner had a weight-average particle diameter of 6.5 μm and contained 21.8% by number of particles of 4.0 μm or less in particle diameter and 3.9% by volume of particles of 10.1 μm or more in particle diameter. As a result of measurement with FPIA-1000, the toner was found to have an average circularity of 0.952 and contain 96.1% by number of particles with a circularity (a) of 0.900 or more and 77.9% by number of particles with a circularity (a) of 0.950 or more.

The particle concentration A before the cut of particles of 3 μm or smaller (the whole particles) was 14,809.7 particles/μl, and the particle concentration B of measured particles of 3 μm or larger was 13,103.3 particles/μl.

This toner was evaluated in the same manner as in Example 1 to find that there were no problems in respect of the transfer efficiency, the fog, the black spots around line images and the shift of image density. However, as the result of measurement of the color tone of solid black images, the value a* was found to be 0.52, the value b* 0.63 and the value L* 21.5. Asking ten people participating in the development of copying machines and the development of toners to visually observe the images measured in the above, the black tint was evaluated. As the result, six in ten people answered that the images had an insufficient black tint.

Comparative Example 2

A comparative toner (q) for evaluation was prepared in the same manner as in Comparative Example 1 except that the iron oxide particles M-7 was used in place of the iron oxide particles M-11. This toner had particle size as shown in Table 2, and circularity as shown in Table 3.

The toner (q) for evaluation was evaluated in the same manner as in Example 1 to obtain the results shown in Tables 4 and 5.

Comparative Example 3

A comparative toner (r) for evaluation was prepared in the same manner as in Example 3 except that, using the crushed product prepared in Comparative Example 1, it was pulverized by means of the I-2 type mill manufactured by Nippon Pneumatic Kogyo K. K. but the subsequent sphering treatment was not made. This toner had particle size as shown in Table 2, and circularity as shown in Table 3.

The toner (r) for evaluation was evaluated in the same manner as in Example 1 to obtain the results shown in Tables 4 and 5.

Comparative Examples 4 and 5

Comparative toners (s) and (t) for evaluationere were prepared in the same manner as in Comparative Example 1 except that the iron oxide particles M-6 and M-10, respectively, were used in place of the iron oxide particles M-11. These toners each had particle size as shown in Table 2, and circularity as shown in Table 3.

The toners (s) and (t) for evaluation were evaluated in the same manner as in Example 1 to obtain the results shown in Tables 4 and 5.

Comparative Example 6

A comparative toner (u) for evaluation was prepared in the same manner as in Comparative Example 1 except that the iron oxide particles M-12 was used in place of the iron oxide particles M-11. This toner had particle size as shown in Table 2, and circularity as shown in Table 3.

The toner (u) for evaluation was evaluated in the same manner as in Example 1 to obtain the results shown in Tables 4 and 5.

Comparative Example 7

A comparative toner (v) for evaluation was prepared in the same manner as in Example 3 except that the temperature of the heat sphering treatment carried out after the pulverization was changed to 82° C. This toner had particle size as shown in Table 2, and circularity as shown in Table 3.

The toner (v) for evaluation was evaluated in the same manner as in Example 1 to obtain the results shown in Tables 4 and 5.

Comparative Example 8

A comparative toner (w) for evaluation was prepared in the same manner as in Comparative Example 1 except that the iron oxide particles M-2 was used in place of the iron oxide particles M-11. This toner had particle size as shown in Table 2, and circularity as shown in Table 3.

The toner (w) for evaluation was evaluated in the same manner as in Example 1 to obtain the results shown in Tables 4 and 5.

TABLE 1

Data of Iron Oxide Particles Used in Toner for Evaluation

| Magnetic material | Ex. or Cp. | Average particle diameter (μm) | Ti content (wt. %) | Based on total Fe content: Total FeO content (wt. %) | Surface portion FeO (wt. %) | Interior FeO (wt. %) | Surf./int. ratio | Magnetic properties measured under magnetic field of 795.8 kA/m: σs (Am²/kg) | σr (Am²/kg) | Hc (kA/m) |
|---|---|---|---|---|---|---|---|---|---|---|
| M-1 | Ex. | 0.13 | 0.4 | 34.7 | 31.9 | 34.9 | 0.91 | 84.6 | 15.9 | 11.6 |
| M-2 | Cp. | 0.13 | 0.2 | 34.9 | 22.1 | 36.8 | 0.60 | 82.9 | 15.9 | 11.7 |
| M-3 | Ex. | 0.13 | 0.3 | 34.8 | 30.2 | 36.1 | 0.84 | 83.9 | 15.8 | 11.7 |
| M-4 | Ex. | 0.13 | 0.8 | 34.5 | 33.3 | 34.5 | 0.97 | 83.2 | 15.6 | 11.6 |
| M-5 | Ex. | 0.13 | 1.3 | 34.1 | 32.5 | 35.7 | 0.90 | 80.0 | 15.3 | 11.5 |
| M-6 | Cp. | 0.13 | 1.6 | 33.8 | 24.8 | 35.2 | 0.70 | 78.2 | 13.1 | 10.3 |
| M-7 | Cp. | 0.04 | 0.4 | 31.4 | 21.5 | 33.8 | 0.64 | 78.1 | 19.3 | 12.1 |
| M-8 | Ex. | 0.15 | 0.4 | 34.9 | 32.2 | 35.6 | 0.90 | 84.8 | 15.7 | 11.3 |
| M-9 | Ex. | 0.22 | 0.4 | 35.1 | 32.7 | 35.3 | 0.93 | 85.2 | 15.5 | 10.9 |
| M-10 | Cp. | 0.31 | 0.4 | 35.9 | 34.1 | 36.0 | 0.95 | 87.1 | 11.6 | 9.8 |

TABLE 1-continued

Data of Iron Oxide Particles Used in Toner for Evaluation

| Magnetic material | Ex. or Cp. | Average particle diameter (μm) | Ti content (wt. %) | Based on total Fe content: Total FeO content (wt. %) | Surface portion FeO (wt. %) | Interior FeO (wt. %) | Surf./int. ratio | Magnetic properties measured under magnetic field of 795.8 kA/m (Am²/kg): σs | σr | Hc (kA/m) |
|---|---|---|---|---|---|---|---|---|---|---|
| M-11 | Cp. | 0.14 | <0.1 | 33.7 | 14.3 | 37.2 | 0.38 | 82.6 | 16.1 | 11.8 |
| M-12 | Cp. | 0.14 | 0.4 | 34.8 | 15.8 | 36.7 | 0.43 | 82.1 | 15.9 | 11.7 |

Ex.: Example, Cp.: Comparative Example, Surf.: Surface portion, int.: interior

TABLE 2

Results of Particle Size Measurement with Coulter Multicizer on Toner for Evaluation

| | Toner | Weight-average particle diameter (μm) | Particles of 4.0 μm or smaller (% by number) | Particles of 10.1 μm or larger (% by volume) |
|---|---|---|---|---|
| Example: | | | | |
| 1 | (a) | 6.5 | 21.3 | 3.8 |
| 2 | (b) | 7.4 | 15.9 | 6.8 |
| 3 | (c) | 7.5 | 17.2 | 7.8 |
| 4 | (d) | 6.5 | 20.9 | 3.6 |
| 5 | (e) | 6.6 | 20.5 | 4.0 |
| 6 | (f) | 6.5 | 21.2 | 3.8 |
| 7 | (g) | 6.4 | 20.5 | 3.6 |
| 8 | (h) | 6.4 | 22.1 | 3.8 |
| 9 | (i) | 5.2 | 28.6 | 1.1 |
| 10 | (j) | 8.8 | 14.1 | 12.0 |
| 11 | (k) | 11.3 | 6.1 | 19.6 |
| 12 | (l) | 6.4 | 22.4 | 4.0 |
| 13 | (m) | 6.4 | 21.8 | 3.9 |

TABLE 2-continued

Results of Particle Size Measurement with Coulter Multicizer on Toner for Evaluation

| | Toner | Weight-average particle diameter (μm) | Particles of 4.0 μm or smaller (% by number) | Particles of 10.1 μm or larger (% by volume) |
|---|---|---|---|---|
| 14 | (n) | 6.5 | 21.5 | 4.1 |
| 15 | (o) | 6.5 | 21.6 | 4.1 |
| Comparative Example: | | | | |
| 1 | (p) | 6.5 | 21.8 | 3.9 |
| 2 | (q) | 6.6 | 20.5 | 3.9 |
| 3 | (r) | 7.5 | 15.8 | 6.8 |
| 4 | (s) | 7.6 | 17.2 | 7.8 |
| 5 | (t) | 7.5 | 18.5 | 8.1 |
| 6 | (u) | 6.6 | 22.1 | 4.2 |
| 7 | (v) | 7.6 | 17.3 | 7.9 |
| 8 | (w) | 6.5 | 22.2 | 4.0 |

TABLE 3

Results of Circularity Measurement with FPIA-1000 on Toner Particles of Examples and Comparative Examples

| | Toner | Average circularity | 0.900 or more (%) | 0.950 or more (%) | Measured particle concentration A (particles/μl) | Measured particle concentration B (particles/μl) | Cut rate Z |
|---|---|---|---|---|---|---|---|
| Example: | | | | | | | |
| 1 | (a) | 0.953 | 95.7 | 78.4 | 15,209.7 | 13,028.3 | 14.3 |
| 2 | (b) | 0.945 | 96.0 | 78.0 | 13,997.7 | 4,279.7 | 69.4 |
| 3 | (c) | 0.966 | 98.2 | 80.3 | 14,221.3 | 5,102.6 | 64.1 |
| 4 | (d) | 0.951 | 95.2 | 78.0 | 14,215.3 | 12,997.6 | 8.6 |
| 5 | (e) | 0.954 | 95.4 | 78.2 | 13,872.1 | 13,000.5 | 6.3 |
| 6 | (f) | 0.951 | 95.1 | 78.0 | 14,998.2 | 12,997.5 | 13.3 |
| 7 | (g) | 0.952 | 95.0 | 77.9 | 15,036.1 | 13,280.5 | 11.7 |
| 8 | (h) | 0.953 | 95.3 | 78.3 | 14,773.5 | 12,974.4 | 12.2 |
| 9 | (i) | 0.959 | 97.4 | 79.2 | 15,111.4 | 13,091.2 | 13.4 |
| 10 | (j) | 0.950 | 93.1 | 95.7 | 13,031.8 | 12,004.7 | 7.9 |

TABLE 3-continued

Results of Circularity Measurement with FPIA-1000 on Toner Particles of Examples and Comparative Examples

| | Toner | Average circularity | 0.900 or more (%) | 0.950 or more (%) | Measured particle concentration A (particles/μl) | Measured particle concentration B (particles/μl) | Cut rate Z |
|---|---|---|---|---|---|---|---|
| 11 | (k) | 0.942 | 90.9 | 55.5 | 13,008.6 | 11,997.7 | 7.8 |
| 12 | (l) | 0.950 | 95.8 | 77.7 | 14,256.2 | 12,887.6 | 9.6 |
| 13 | (m) | 0.951 | 95.6 | 76.9 | 14,889.2 | 12,456.6 | 16.3 |
| 14 | (n) | 0.950 | 95.1 | 77.2 | 15,068.1 | 13,548.8 | 10.1 |
| 15 | (o) | 0.952 | 95.0 | 76.3 | 14,051.3 | 12,997.6 | 7.5 |
| Comparative Example: | | | | | | | |
| 1 | (p) | 0.952 | 96.1 | 77.9 | 14,809.7 | 13,103.8 | 11.5 |
| 2 | (q) | 0.951 | 95.6 | 76.6 | 14,411.6 | 12,998.7 | 9.8 |
| 3 | (r) | 0.938 | 88.4 | 66.3 | 15,002.3 | 4,456.1 | 70.3 |
| 4 | (s) | 0.939 | 89.9 | 65.9 | 14,998.2 | 5,009.6 | 66.6 |
| 5 | (t) | 0.940 | 90.2 | 64.8 | 14,291.1 | 4,572.2 | 68.0 |
| 6 | (u) | 0.951 | 90.6 | 73.4 | 15,001.6 | 12,984.2 | 13.4 |
| 7 | (v) | 0.972 | 99.5 | 82.4 | 14,981.6 | 13,412.9 | 10.5 |
| 8 | (w) | 0.950 | 90.3 | 72.9 | 14,835.6 | 12,912.7 | 13.0 |

TABLE 4

Evaluation Results in Examples and Comparative Examples

| | Toner | Transfer efficiency A (Evaluation 1) (%) | Transfer efficiency B (Evaluation 2) (%) | Color tone (Evaluation 3) | (Evaluation 4) Fog | (Evaluation 4) Black spots | Density stability (Evaluation 5) |
|---|---|---|---|---|---|---|---|
| Example: | | | | | | | |
| 1 | (a) | 90 | 87 | AA | AA | AA | AA |
| 2 | (b) | 89 | 87 | AA | AA | AA | AA |
| 3 | (c) | 92 | 89 | AA | A | B | AA |
| 4 | (d) | 90 | 86 | A | AA | A | AA |
| 5 | (e) | 91 | 88 | AA | A | AA | AA |
| 6 | (f) | 91 | 87 | AA | A | AA | AA |
| 7 | (g) | 90 | 86 | AA | A | A | AA |
| 8 | (h) | 90 | 86 | AA | B | B | AA |
| 9 | (i) | 92 | 89 | AA | B | B | AA |
| 10 | (j) | 86 | 81 | AA | AA | A | AA |
| 11 | (k) | 83 | 79 | AA | AA | A | AA |
| 12 | (l) | 90 | 85 | AA | B | B | B |
| 13 | (m) | 89 | 85 | AA | A | A | AA |
| 14 | (n) | 90 | 85 | AA | AA | A | AA |
| 15 | (o) | 89 | 85 | AA | AA | A | B |
| Comparative Example: | | | | | | | |
| 1 | (p) | 90 | 87 | C | A | AA | AA |
| 2 | (q) | 91 | 87 | D | C | A | D |
| 3 | (r) | 73 | 67 | C | B | A | B |
| 4 | (s) | 75 | 70 | B | C | A | D |
| 5 | (t) | 76 | 70 | AA | B | D | C |
| 6 | (u) | 89 | 85 | C | C | B | C |
| 7 | (v) | 91 | 88 | AA | B | C | A |
| 8 | (w) | 89 | 85 | C | A | A | A |

TABLE 5

Results of L*a*b* Measurement in Examples and Comparative Examples

| | Toner | Value a* (Evaluation 3) | Value b* (Evaluation 3) | Value L* (Evaluation 3) |
|---|---|---|---|---|
| Example: | | | | |
| 1 | (a) | 0.36 | −0.03 | 21.1 |
| 2 | (b) | 0.29 | −0.04 | 21.2 |
| 3 | (c) | 0.30 | 0.00 | 21.1 |

TABLE 5-continued

Results of L*a*b* Measurement in Examples and Comparative Examples

| | Toner | Value a* (Evaluation 3) | Value b* (Evaluation 3) | Value L* (Evaluation 3) |
|---|---|---|---|---|
| 4 | (d) | 0.40 | −0.09 | 21.2 |
| 5 | (e) | 0.22 | −0.17 | 21.8 |
| 6 | (f) | 0.20 | −0.18 | 21.2 |

TABLE 5-continued

Results of L*a*b* Measurement in Examples and Comparative Examples

| | Toner | Value a* (Evaluation 3) | Value b* (Evaluation 3) | Value L* (Evaluation 3) |
|---|---|---|---|---|
| 7 | (g) | 0.13 | −0.23 | 21.1 |
| 8 | (h) | 0.10 | −0.27 | 21.5 |
| 9 | (i) | 0.23 | −0.05 | 22.1 |
| 10 | (j) | 0.30 | 0.00 | 21.0 |
| 11 | (k) | 0.30 | 0.02 | 20.8 |
| 12 | (l) | 0.33 | 0.01 | 20.3 |
| 13 | (m) | 0.30 | 0.00 | 21.0 |
| 14 | (n) | 0.24 | −0.06 | 22.3 |
| 15 | (o) | 0.21 | −0.08 | 22.6 |
| Comparative Example: | | | | |
| 1 | (p) | 0.52 | 0.63 | 21.5 |
| 2 | (q) | 0.61 | 0.66 | 20.8 |
| 3 | (r) | 0.69 | 0.69 | 23.1 |
| 4 | (s) | 0.41 | 0.41 | 22.0 |
| 5 | (t) | 0.08 | −0.44 | 21.0 |
| 6 | (u) | 0.46 | 0.42 | 21.5 |
| 7 | (v) | 0.36 | 0.09 | 21.0 |
| 8 | (w) | 0.42 | 0.41 | 21.3 |

What is claimed is:

1. A magnetic black toner comprising magnetic black toner particles containing at least a binder resin and a magnetic material;

said toner having a weight-average particle diameter X (μm) of from 5 μm to 12 μm, and said toner having, in its particles of 3 μm or more in diameter, at least 90% by number of particles with a circularity (a) of 0.900 or more in number-based circularity distribution of circularity (a) as determined from the following equation (1), and having an average circularity of from 0.940 to 0.970;

$$\text{Circularity } (a)=L_0/L \quad (1)$$

where $L_0$ represents the circumferential length of a circle having the same projected area as a particle image, and L represents the circumferential length of the particle image;

said magnetic material comprising iron oxide particles which:

1) have an average particle diameter of from 0.10 μm to 0.30 μm;

2) contain titanium or a titanium compound in an amount of from 0.3% by weight to 1.5% by weight in terms of titanium, based on the total weight of the iron oxide particles; and 3) have the ratio of the proportion of FeO to the total Fe content in 10% by weight from the particle surface, A %, to the proportion of FeO to the total Fe content in the remainder 90% by weight, B %, which satisfies the following expression (2):

$$0.7 \leqq A/B \leqq 1.0 \quad (2);$$

and an inorganic fine powder being externally added to the surfaces of said magnetic black toner particles.

2. The magnetic black toner according to claim 1, wherein, in a solid black image with a transmission density of from 1.2 to 1.7, the values a* and b* in the measurement by the L*a*b* color system satisfy the relationship of the following expressions (3) and (4):

$$0 \leqq \text{value } a^* \leqq 0.5 \quad (3)$$

$$-0.5 \leqq \text{value } b^* \leqq 0.8 \quad (4)$$

(provided that the average particle diameter of the iron oxide particles is within the range of from 0.10 μm to 0.30 μm.).

3. The magnetic black toner according to claim 1, wherein said iron oxide particles contain titanium in an amount of from 0.4% by weight to 1.2% by weight in terms of titanium, based on the total weight of the iron oxide particles.

4. The magnetic black toner according to claim 1, wherein said iron oxide particles have a coercive force of from 1.6 kA/m to 12.0 kA/m, a saturation magnetization of from 50 $Am^2/kg$ to 200 $Am^2/kg$ and a residual magnetization of from 2 $Am^2/kg$ to 20 $Am^2/kg$, as magnetic properties under application of a magnetic field of 795.8 kA/m.

5. The magnetic black toner according to claim 1, which comprises a toner with particle diameter of 4.0 μm or less in a proportion of 40% by number or less and a toner with particle diameter of 10.1 μm or more in a proportion of 25% by volume or less.

6. The magnetic black toner according to claim 1, wherein said iron oxide particles are octahedral.

7. The magnetic black toner according to claim 1, wherein said iron oxide particles are contained in an amount of from 50 parts by weight to 150 parts by weight based on 100 parts by weight of the binder resin.

8. The magnetic black toner according to claim 1, wherein said iron oxide particles are contained in an amount of from 60 parts by weight to 120 parts by weight based on 100 parts by weight of the binder resin.

9. The magnetic black toner according to claim 1, which is a toner in which;

a) the relationship between cut rate Z and toner weight-average particle diameter X (μm) satisfies the following expression (5):

$$\text{Cut rate } Z \leqq 5.3 \times X \quad (5)$$

provided that the cut rate Z is represented by the following expression (3):

$$Z=(1-B/A)\times 100 \quad (6)$$

where A is the particle concentration (number of particles/μl) of the whole measured particles as measured with a flow-type particle image analyzer FPIA-1000, manufactured by Toa Iyou Denshi K. K., and B is the particle concentration (number of particles/μl) of measured particles of 3 μm or more in circle-corresponding diameter; and in the particles of 3 μm or more in diameter of the toner and in the number-based circularity distribution of the circularity (a), the relationship between the number-based cumulative value Y of particles with a circularity (a) of 0.950 or more and the toner weight-average particle diameter X satisfies the following expression (7):

Number-based cumulative value Y of particles with a circularity (a) of 0.950 or more $$\geqq \exp 5.51 \times X^{-0.645} \quad (7)$$

provided that the toner weight-average particle diameter X is from 5.0 μm to 12.0 μm; or b) the relationship between the cut rate Z and the toner weight-average particle diameter X (μm) satisfies the following expression (8):

$$\text{Cut rate } Z > 5.3 \times X \quad (8);$$

and in the particles of 3 μm or more in diameter of the toner and in the number-based circularity distribution of the circularity (a), the relationship between the number-based cumulative value Y of particles with a circularity (a) of 0.950 or more and the toner weight-average particle diameter X satisfies the following expression (9):

Number-based cumulative value Y of particles with a circularity (a) of 0.950 or more $$\geqq \exp 5.37 \times X^{-0.545} \quad (9)$$

provided that the toner weight-average particle diameter X is from 5.0 μm to 12.0 μm.

10. The magnetic black toner according to claim 1, wherein said toner particles comprise particles having been formed through the step of melt kneading, the step of pulverization and the step of classification, and having been formed by:

melt-kneading a mixture containing at least the binder resin and a colorant to obtain a kneaded product;

cooling the kneaded product to obtain a cooled product;

crushing the cooled product by a crushing means to obtain a powder material comprised of a crushed product;

pulverizing the powder material to form a pulverized product having a weight-average particle diameter of from 4 μm to 12 μm and containing 70% by number or less of particles of 4.0 μm or less in particle diameter and 20% by volume or less of particles of 10.1 μm or more in particle diameter;

classifying the pulverized product by means of a multi-division air classifier into at least a fine powder, a median powder and a coarse powder; and obtaining the toner particles from the median powder thus classified.

* * * * *